US007651984B2

(12) United States Patent
Cook et al.

(10) Patent No.: US 7,651,984 B2
(45) Date of Patent: Jan. 26, 2010

(54) LUBRICANT FROM WATER IN OIL EMULSION WITH SUSPENDED SOLID BASE

(75) Inventors: Stephen J. Cook, Belper (GB); Alexandra Mayhew, Burton on Trent (GB); Helena M. Cressey, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 874 days.

(21) Appl. No.: 10/481,486

(22) PCT Filed: Jun. 27, 2002

(86) PCT No.: PCT/US02/20750

§ 371 (c)(1),
(2), (4) Date: May 27, 2004

(87) PCT Pub. No.: WO03/044138

PCT Pub. Date: May 30, 2003

(65) Prior Publication Data

US 2004/0235684 A1 Nov. 25, 2004

(51) Int. Cl.
*C10M 125/10* (2006.01)
*C10M 173/00* (2006.01)
*B01F 3/08* (2006.01)

(52) U.S. Cl. ..... 508/178; 508/180; 508/287; 508/293; 508/572; 508/574; 516/21; 516/27

(58) Field of Classification Search ..... 508/178, 508/180; 516/21, 27
See application file for complete search history.

(56) References Cited

U.S. PATENT DOCUMENTS

| | | | | |
|---|---|---|---|---|
| 2,676,925 | A | 4/1954 | Lindstrom et al. | 252/18 |
| 2,865,857 | A | 12/1958 | Walker | 252/33 |
| 2,944,023 | A | 7/1960 | Kolarik | 252/33.4 |
| 2,975,132 | A | 3/1961 | Ferm | 252/33.3 |
| 3,206,399 | A | 9/1965 | Davis et al. | 252/40.5 |
| 3,269,946 | A | 8/1966 | Wiese | 252/32.5 |
| 3,281,356 | A | 10/1966 | Coleman | 252/32.7 |
| 3,342,733 | A | 9/1967 | Robbins et al. | 252/33 |
| 3,361,669 | A | 1/1968 | Van Westen et al. | 252/40.7 |
| 3,378,494 | A | 4/1968 | Berger | 252/77 |

(Continued)

FOREIGN PATENT DOCUMENTS

CA 2104505 2/1994

(Continued)

OTHER PUBLICATIONS

Corresponding PCT International Publication No. WO 03/044138 and Search Report published May 30, 2003.

*Primary Examiner*—Ellen M McAvoy
(74) *Attorney, Agent, or Firm*—Samuel B. Laferty; David M. Shold; Christopher D. Hilke

(57) ABSTRACT

A lubricant in the form of a water or oil insoluble solvent in oil emulsion is described where a base (soluble or dispersible in said oil-insoluble solvent or water) is present in the dispersed phase. These lubricants are beneficial in various applications such as internal combustion engines where the oil needs enough basicity to neutralize any inorganic acids generated by sulfur present in the fuel.

28 Claims, 8 Drawing Sheets

Analyses of the Drain Oils – TBN

U.S. PATENT DOCUMENTS

| | | | | |
|---|---|---|---|---|
| 3,981,813 | A | 9/1976 | Den Herder et al. | 252/75 |
| 4,159,252 | A * | 6/1979 | Wainwright et al. | 508/168 |
| 4,447,348 | A * | 5/1984 | Forsberg | 252/75 |
| 4,708,753 | A * | 11/1987 | Forsberg | 149/2 |
| 5,756,432 | A | 5/1998 | Born et al. | 508/391 |
| 6,204,225 | B1 * | 3/2001 | Lightcap, Jr. | 508/178 |
| 6,518,225 | B1 * | 2/2003 | Fukutani et al. | 508/180 |

FOREIGN PATENT DOCUMENTS

| | | |
|---|---|---|
| EP | 0584711 B1 | 3/1994 |
| EP | 0839894 B1 | 5/1998 |
| GB | 800895 | 9/1958 |
| GB | 827531 | 2/1960 |
| GB | 868893 | 5/1961 |

* cited by examiner

Figure 1: Analyses of the Drain Oils – TBN
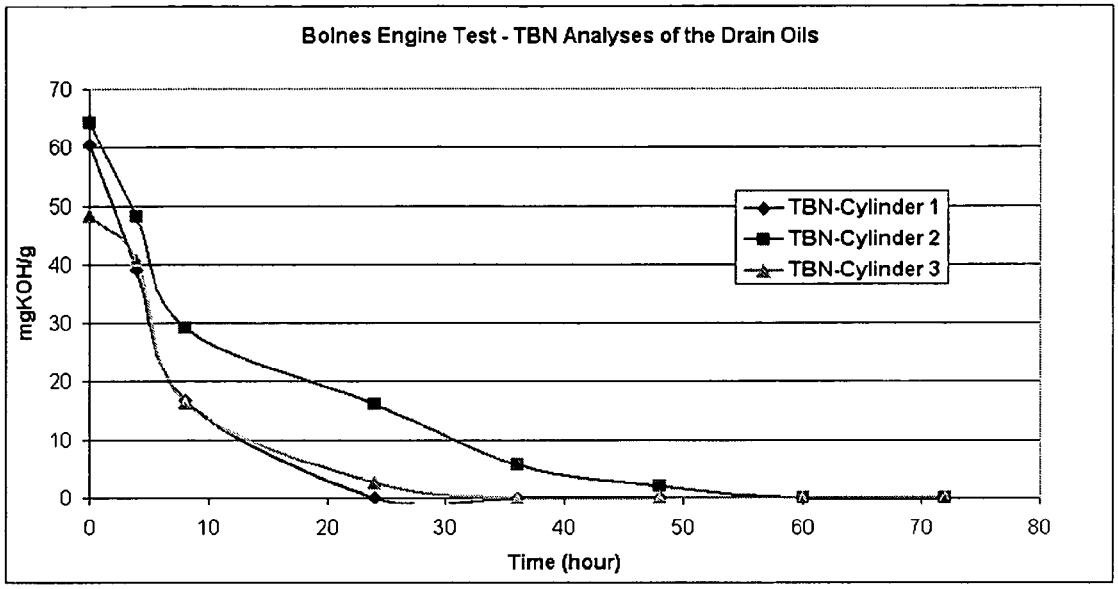

Figure 2: Analyses of the Drain Oils – TAN
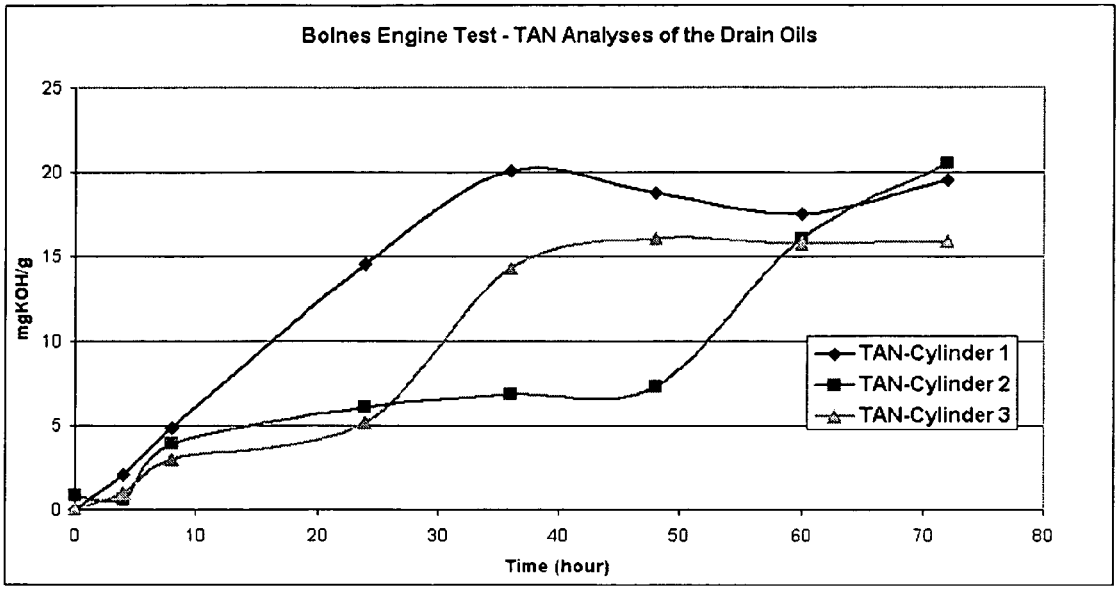

Figure 3: ICP/AES Analyses of the Drain Oils – Fe
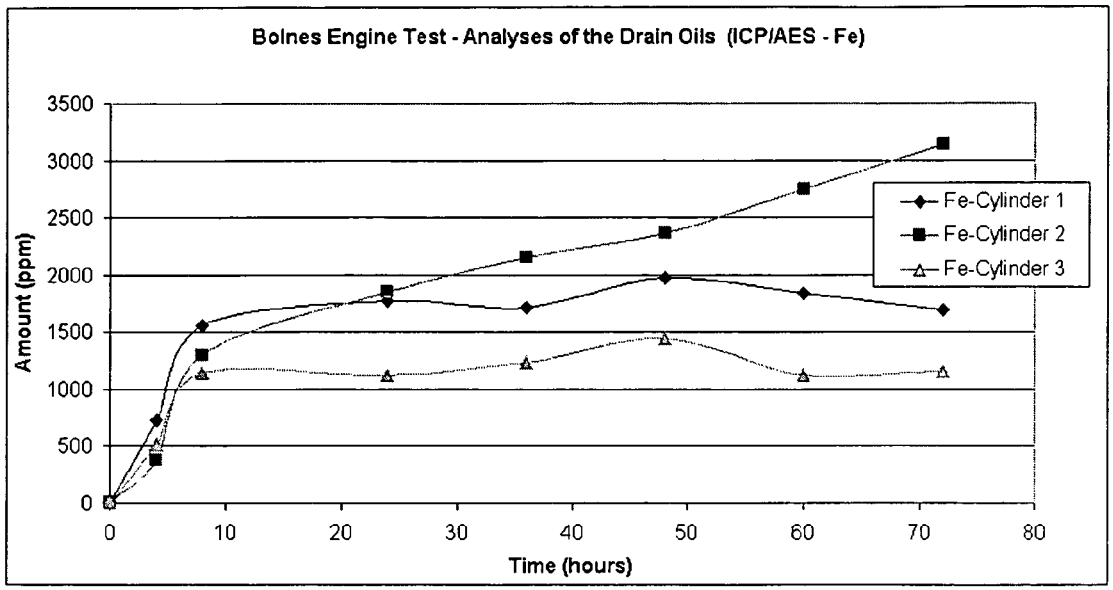

Figure 4: High Temperature and Neutralisation Test Cell
LUBRICANT GLASS TEST CELL
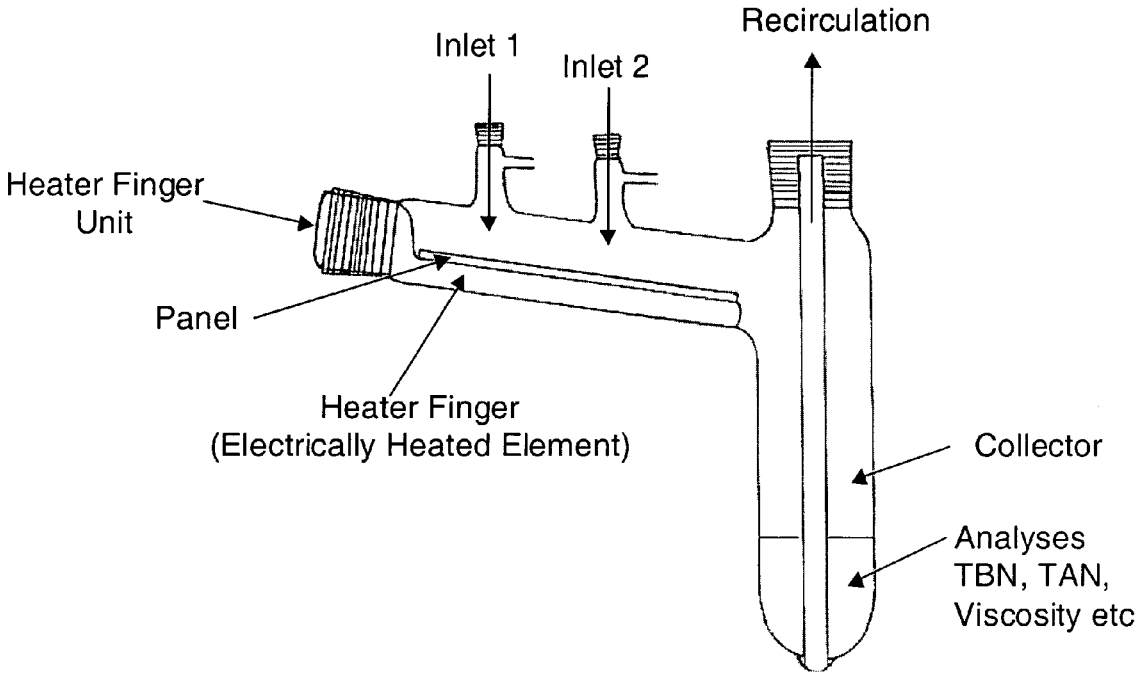

Figure 5: Analyses of the Drain Oils/Average Results – TBN
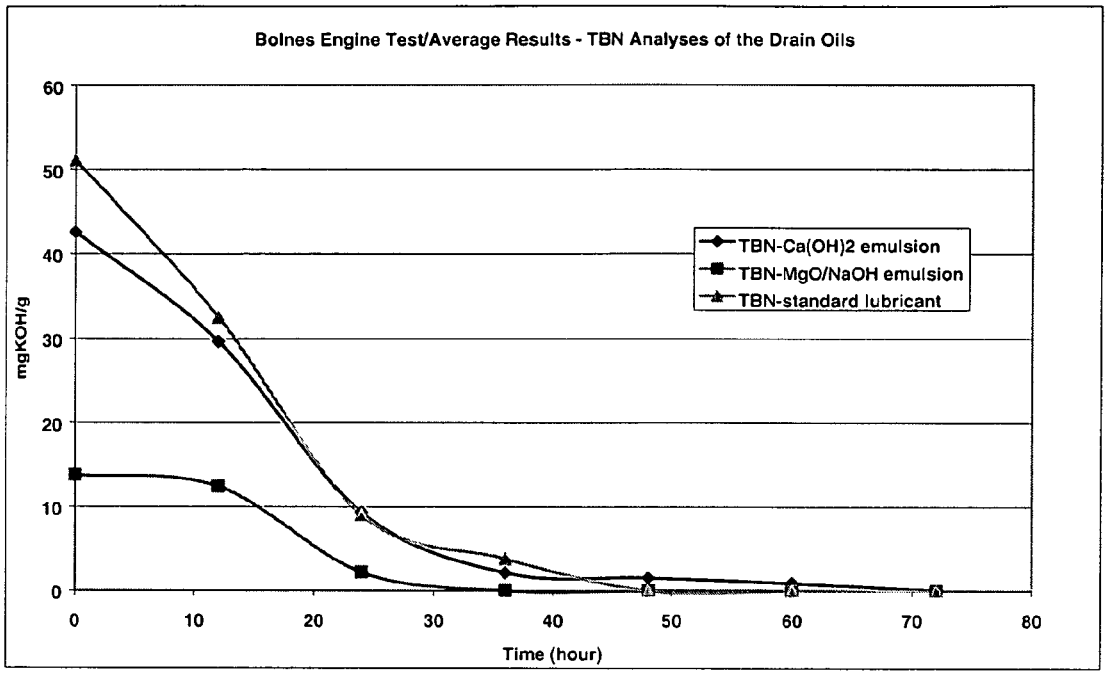

Figure 6: Analyses of the Drain Oils/ Average Results – TAN
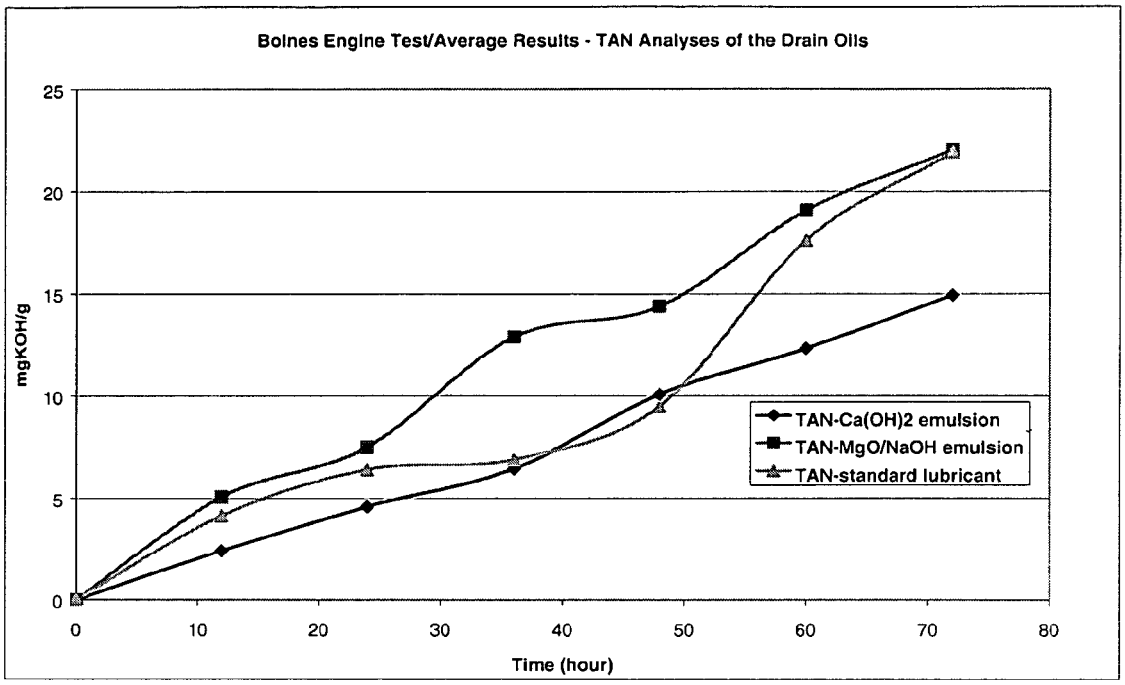

Figure 7: Analyses of the Drain Oils/Average Results – Excess TAN over TBN
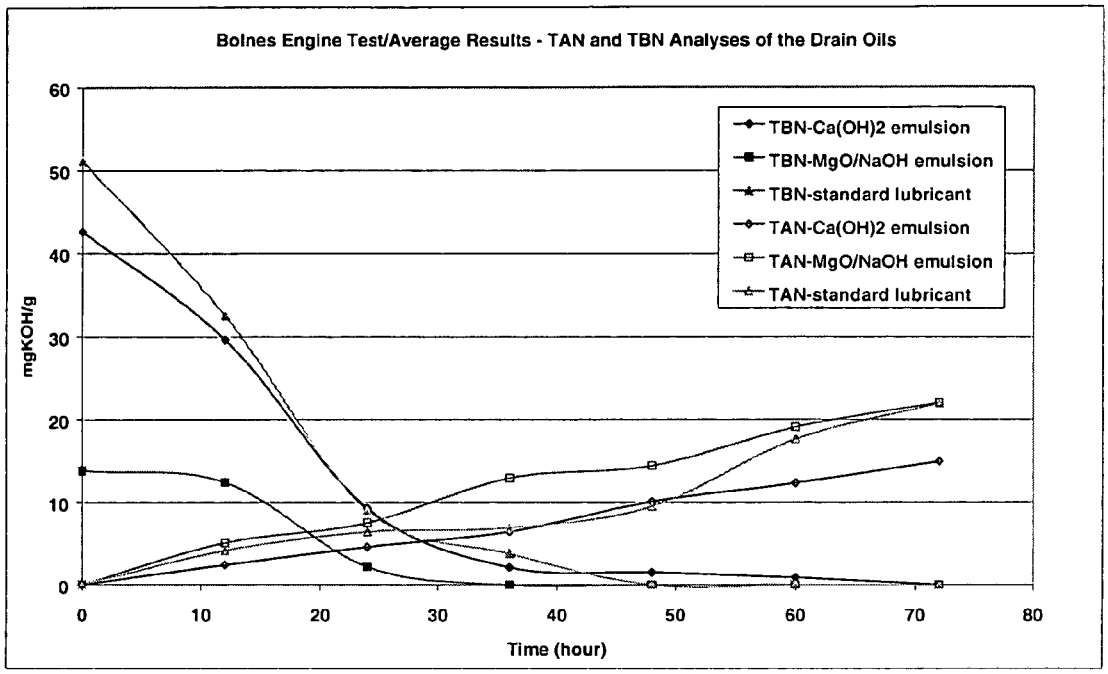

Figure 8: ICP/AES Analyses of the Drain Oils/ – Fe
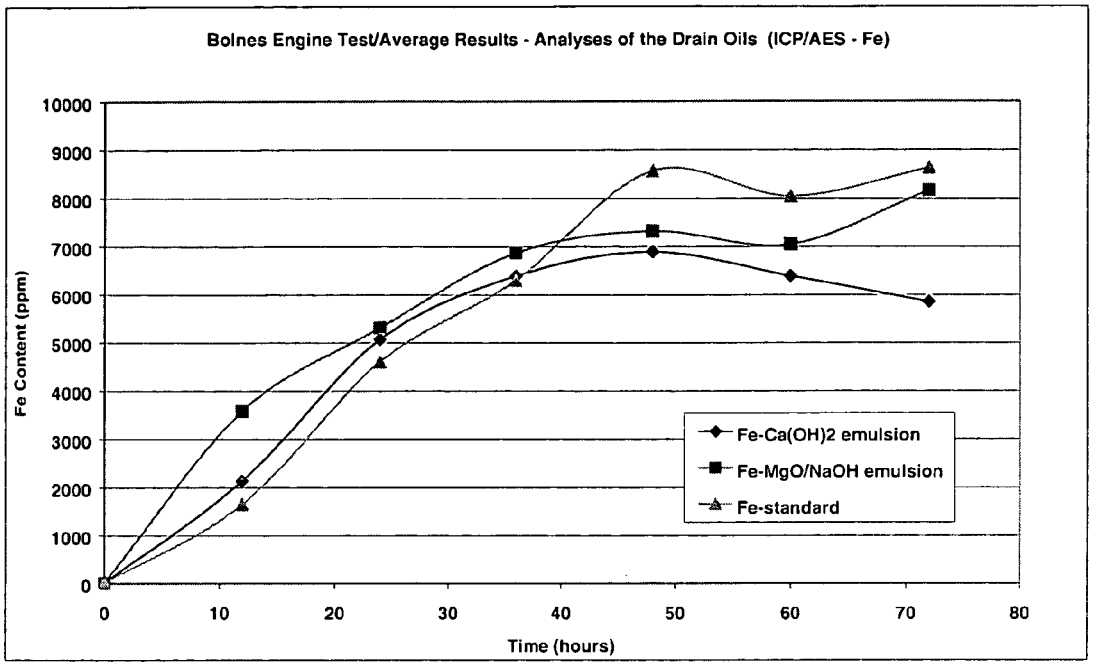

LUBRICANT FROM WATER IN OIL EMULSION WITH SUSPENDED SOLID BASE

FIELD OF INVENTION

Lubricants with excess basicity, characterized as total base number (TBN) are used as lubricants in internal combustion engines where atoms such as sulfur, nitrogen and carbon generate acidic combustion products that cause additional wear. In the past the overbased components where bases were reacted in the oil phase with gases like $CO_2$ in the presence of sulfonic acids contributed basicity. Water soluble or water dispersible bases are proposed as alternatives to overbased metals. The bases can be incorporated into an emulsified water phase. These oils can be used in other lubricant applications.

BACKGROUND OF INVENTION

A variety of lubricant oils are available having various total base numbers. One reason for having a total base number above zero in a lubricant is that acidic products are more likely to cause corrosion and wear to metal parts of a device than bases, which tend not to be involved in corrosion. Thus lubricants are formulated with sufficient excess base that over their intended lifetime, they remain neutral or slightly basic.

One particular use of a lubricant with a high total base number is in marine diesel applications which economically burn residual fuels with a sulfur content up to about 4.5 weight percent. Due to the high amount of sulfur containing species in the economical residual fuel, the combustion products include high amount of acidic $SO_x$ which causes additional wear to the cylinder wall and the rings of the piston. A solution to this lubrication/corrosion problem caused by the $SO_x$ is to include excess base in the lubricant oil so that the $SO_x$ is converted to a metal salt of the acid, which has less tendency to cause corrosion or wear. In many marine diesel applications the cylinder oil is injected near the rings of the piston on a continual basis to provide both continued lubrication and replace the base lost to neutralization. In these applications the cylinder lubricant is continuously consumed rather than returned to a sump. The marine diesel lubricant also needs good lubricity, dispersancy, oxidative stability and antiwear properties.

Traditional marine diesel lubricant formulations used overbased metals (detergents) for acid neutralization. Preparing basic complexes from oil soluble acids, bases, and acidic gases are described in U.S. Pat. Nos. 2,616,904; 2,616,905; 2,695,910; and 2,739,125. These patents typically attribute the ability to include high amounts of base in a form suitable for lubrication and stable against aggregation to complexes formed with various reaction procedures and promoters, sometimes including water and sometimes not, and of the chemical reaction between the base and the $CO_2$ in the oil. They often quote a high basic metal content or ratio as an indication of preparing a useful complex.

GB 789,920 describes stable dispersions of inorganic metal compounds in lubricating oil and methods of making the same. Such compositions possessing increased detergency and increase reserve basicity find utility as additives in lubricating oils and possibly as corrosion inhibitors. The oil soluble surface active agents are typically sulfonates and the compositions include an aliphatic alcohol having less than six carbon atoms, which is removed. It appears that a mutual solvent for the alcohol and the lubricating oil, such as benzene, is used to form a homogeneous mass that later separate into phases when the benzene and alcohol are removed.

Emulsions of water in oil have been described for use in hydraulic applications such as in U.S. Pat. Nos. 3,269,946; 3,281,356; 3,311,561; and 3,378,494 where fire resistance was provided by the high water content of the fluid and the use temperature was low enough that the water of the water in oil emulsion was not readily evaporated. Water in oil emulsions were generally not desired in engine oils as discussed in column 1 of U.S. Pat. No. 3,509,052, lines 41-55, where a mayonnaise-like sludge was observed in the rocker arm covers and oil fill caps of smaller car engines when moisture condensed from the air and was emulsified into the engine oil.

Water in oil emulsions are also used as liquid fuels in some patent applications such as U.S. Pat. No. 4,002,435. An water in oil emulsion is described therein comprising a hydrocarbon, water, a water-soluble alcohol, and a novel combination of surface-active agents to provide a clear fuel, which is stable against phase separation.

SUMMARY OF INVENTION

A lubricant having a total base number above 0.25 or 1 mg KOH/g is described. The lubricant comprises a continuous oil phase, a discontinuous water phase (or oil insoluble solvent rich phase), and a base either dissolved or dispersed in the water (or oil insoluble solvent) phase. A preferred embodiment is a water in oil lubricant, which uses at least a portion of solid base components, such as $Ca(OH)_2$, $CaCO_3$, MgO/NaOH is, is suspended in an oil insoluble solvent (e.g. water). These bases, not being complexed with a strong organic acid, can function slightly differently than overbased metals and provide efficiencies in operating marine diesel engines over lubricants using strictly overbased metals. Optionally the water or oil insoluble solvent can be partially or fully removed in the final product. Optionally the solid base can be dispersed or suspended without the use of an oil-insoluble solvent. Optionally the solid base can be dispersed or suspended without the use of an oil-insoluble solvent. The base in the dispersed (discontinuous) phase comprises at least a portion or all of the base in the lubricating composition. Preferred bases include but are not limited to calcium hydroxide, calcium carbonate, magnesium oxide, magnesium hydroxide, potassium hydroxide, guanidine carbonate and sodium hydroxide. The bases described herein can be added by simple dissolution in a solvent and are not made by prior art methods of chemically reacting at least two components within the oil phase (in situ). In marine diesel applications the total base number is desirably above 10, 20, 30, or 40 or 40 mg KOH/g.

The lubricant can also comprise various conventional lubricating additives to assist in the performance of the lubricant such as dispersants, detergents (including neutral and overbased detergents), extreme pressure agents, antioxidants, viscosity index modifiers, etc. The lubricating oil can be selected from a wide variety of oils of API Groups I through V including mineral oils or combinations of grades or synthetic or combinations with synthetics. A preferred use of the lubricant is as a cylinder lubricant in a marine diesel engine, which can burn high sulfur content fuels. Other lubricant applications are possible. The high total base number of the lubricant can minimize the corrosive effect of sulfuric acid on the metal parts of the marine diesel engine. The lubricant can be used in a variety of other applications, such as an internal combustion engine using low sulfur fuel, where an oil with some basicity is beneficial to avoid the effects of acidic reaction products or to extend the useful life of the lubricant.

BRIEF DESCRIPTION OF THE DRAWINGS

FIG. 1 is a plot of the total base number of the drain oils in a marine diesel engine as a function of time for the three different cylinders in the same engine.

FIG. 2 is a plot of the total acid number of the drain oils.

FIG. 3 is a plot of the Fe content as a function of time.

FIG. 4 is an illustration of the equipment for the hot-bar and high temperature neutralization test for oils.

FIGS. 5-8 are the same plots as 1-3 except a solid dispersion of base was used instead of dissolved base. FIGS. 5-8 are the same plots as 1-3 except a solid dispersion of base was used instead of dissolved base.

DETAILED DESCRIPTION OF THE INVENTION

Lubricating oils having increased basicity due to a dispersed base therein are described. The base is typically added as dissolved or dispersed base in water or other oil insoluble solvent. The water or other oil insoluble solvent is then dispersed as a water or solvent in oil emulsion using the lubricating oil as the continuous phase. The water or oil insoluble solvent can remain or can be partially or fully removed. An emulsifier(s) is used to colloidally stabilize the dispersions. These resulting oils can be used over a variety of temperature ranges including use in the combustion chamber of an internal combustion engine. The use of bases soluble or dispersible in water or other oil insoluble solvents within oil has been limited in the past due to the limited solubility of these compounds in hydrocarbon oils. The use of water or other oil insoluble solvent(s) emulsified in oil has been discouraged except for the use of water in oil emulsions for flame resistant hydraulic fluids and related lower temperature applications. Other oil insoluble solvents like lower alcohols and ethers have been avoided in lubricants for volatility reasons.

A major component to the lubricating oil is a base oil, hydrocarbon in most situations although some synthetic oils that would not be strictly defined as hydrocarbon could be used (e.g. esters and polyol esters). The word major is used because the amount of hydrocarbon based oil is often more than 50 weight or volume percent but it need only be the continuous phase and can be as little as 20 or 30 weight percent of the final formulation, depending on the application. In marine diesel application the hydrocarbon oil is typically more than 50 weight percent of the composition and often more than 75 weight percent of the composition.

Emulsifiers help emulsify the oil insoluble solvent e.g. water in the hydrocarbon oil. The emulsifier(s) can be any known emulsifier useful to disperse oil insoluble solvents e.g. water in oil. Preferably the emulsifiers include one high HLB (hydrophilic/lipophilic balance) emulsifier and/or one low HLB emulsifier. The low HLB emulsifier can be an ester/salt made by reacting polyisobutenyl succinic anhydride with ethylene glycol and dimethyl ethanol amine in an equivalent ratio of about 2:1:2. This emulsifier can have a high molecular weight polyisobutylene chain (~1500 MW). The high HLB emulsifier can be an ester/salt made by reacting hexadecyl succinic anhydride with dimethylethanolamine in an equivalent ratio of about 1:1 (low molecular weight) or a salixarene emulsifier. The emulsifier(s) can be present in any amount to effectively emulsify the water and water soluble or water dispersible base in the hydrocarbon oil phase. Preferred amounts of emulsifier include from about 0.5 to about 15 weight percent based on the weight of the formulated lubricant.

Oil Insoluble Solvent

Water or another oil insoluble solvent or a blend(s) thereof is a necessary component to the system. Water soluble organic materials or salts can be added to depress the freezing point of the water/solvent and/or to make the water/solvent more effective in dissolving or dispersing the base. While very pure water was used in some to the examples and is preferred since it would eliminate contaminants that might interfere with other additives or function, it is anticipated that water with various impurities could be used in marine diesel applications without any significant disadvantages. Therefore water will include deionized water, tap water, recycled water, gray ship water, seawater, etc. Water can be up to 50 weight percent of the formulated lubricant as long as it remains a dispersed phase rather than the continuous phase. Preferred amounts of water for marine diesel applications are from about 5 to about 50 weight percent of the formulated lubricant and more desirably from about 5 to about 30 weight percent. Preferred amounts of water and/or oil insoluble solvents for lubricants for general internal combustion engines are from about 1, 2, or 3 to about 10, 20 or 30 weight percent of the formulated lubricant.

Oil insoluble solvents include C1-C5 monohydric and polyhydric alcohols, C2-C5 ethers and polyethers and polyethers, and various other solvents that are not soluble in SAE 30 paraffinic oils to an extent of 1 g/100 ml of oil at 25 C. Ammonia and other amines may be added to the water/solvent/blend to enhance one or more properties necessary of the solvent or of the final dispersion of base.

Base

A water soluble or water dispersible base is a necessary component to the formulated lubricant. The base need not be a pure component but might be a mixture of several different bases or a partially neutralized base. One part of the base might be water soluble and the other part water dispersible. It is desirable that the base has minimal particulate material after dispersion having a dimension between ten micron and a millimeter, these may be present in small amounts and can be filtered out if they become a problem (either before or after emulsifying the particulate material) such a settling or become involved plugging lines or orifices. Typically bases that can be used include but are not limited to potassium, sodium, calcium, magnesium, lithium or aluminum hydroxide; potassium, sodium, calcium, magnesium or lithium carbonate or bicarbonate; potassium, sodium, calcium, magnesium, or lithium salts of C1-C5 organic acids; magnesium oxide; ammonia; guanidine carbonate; urea; or combinations thereof. Guanidine carbonate and urea are desirable as they are considered as ashless additives and would be expected to decompose and yield ammonia or ammonia type bases upon exposure to elevated temperatures. The base can be any water soluble nitrogen containing compound that would contribute basicity to the lubricating oil. These nitrogen containing compounds would include the amines as defined as components of emulsifiers in the emulsifier's portion of this application along with salted version of those amines e.g. those amines reacted or partially reacted with mineral acids such as sulfuric acid or low molecular weight organic acids such as acetic acid or maleic acid. For this application it would be possible to also use the same amines coupled with formaldehyde or polyalcohol such as tris(hydroxymethyl)aminomethane. The nitrogen containing compound could also be a polyether amine e.g. a poly(alkeneoxide) of low or high molecular weight with one or more terminal amine groups. Preferred bases include NaOH, $Ca(OH)_2$, $CaCO_3$, KOH, or blends thereof When using NaOH or KOH, MgO and $Mg(OH)_2$ are desirable as some or all of the base in engine lubricant applications when a high amount of vanadium is present in the fuels. They minimize a vanadate problem associated with the vanadium. While KOH was used in the examples other bases are just as preferred.

While the base can be present in almost any amount preferred ranges for marine diesel applications include from about 0.5 to about 30 weight percent based on the weight of the formulated lubricant and more desirably from about 5 to about 30 weight percent. Preferred amounts of base for lubricants for general internal combustion engines are from about 0.1, 0.2, or 0.3 to about 10 or 30 weight percent.

The formulated lubricant for marine diesel will desirably have a total base number in excess of 10, 20, 30, 40, or 60 units where a unit is equivalent to one milligram of KOH/gram of formulated lubricant. More desirably the lubricant will have a total base number between 20 and 100 or 150 and preferably between 40 and 100 or 150. Preferred TBN values for lubricants for general internal combustion engines are from about 1, 2, or 3 to about 10 or 20. TBN values for lubricants other than engines, e.g. farm tractor lubricant, automatic transmission fluids, gear oils, and hydraulic fluids can go down as low as 0.25 mg KOH/g and is preferably from 0.25 to 10 or 20 mg KOH/g of lubricant. Desirably the lubricant will have at least 50% of its total base number contributed by the base that was soluble or dispersible in water or other oil insoluble solvent. Desirably in marine applications at least 10, 20, or 30 units of TBN will be attributable to the base added to the lubricant with an oil insoluble solvent (e.g. water). The remainder of the total base number may be provided by a variety of overbased oil soluble components such as overbased detergents that are still included in the composition.

The base added in this application will be dispersed, often as a dissolved base, in an oil insoluble solvent (e.g. water) that is then emulsified in the oil. The dispersed phase can be present as a dispersed nanoparticle or micron sized particle, if the oil insoluble solvent has been removed. The base, or at least the majority of the base will not be solubilized into the oil on a molecular scale. Further the base component according to this invention will not be part of those overbased metal compounds described in patents such as U.S. Pat. Nos. 2,626,904; 3,626,905; 3,695,910 or 2,739,125 where a first base is added to the oil along with an oil soluble acid or surfactant and then said base is chemically reacted with another chemical, typically a gas such as $CO_2$ or $SO_2$, to form another second different base in situ in the oil phase, said second base having different solubility or dispersibility in the oil phase due to the method of preparation and the presence of oil soluble acid or surfactant. The base component of this invention will be similar to the overbased metal compounds in that desirably the ratio of equivalents of base to total equivalents of anionic groups on the surfactants will be above 2.5, more desirably above 5, and preferably above 10. Anionic groups on surfactants are well known and include $COO^-$ and $SO_3^-$. These high ratios are indicative that the base in not simply being carried as the counter ion to the surfactant groups. These overbased components formed by in situ chemical reactions may be present as other functional additives in the lubricant and may be formed in trace amounts due to exposure of bases to trace $CO_2$ in the air.

As expressed above the bases added with the oil insoluble solvents, e.g. water, generally have low oil solubility and thus are present in the dispersed phase, i.e. in the dispersed oil insoluble solvents, or if the oil insoluble solvent has been partially or fully remove, the base can become the major or only component in the dispersed phase, stabilized as a colloidal dispersion by the emulsifier. Dispersed phases above 100 microns in any dimension are less preferred in colloidal dispersions because they are harder to stabilize than smaller sized phases and can contribute to haziness. Dispersed phases above 20 microns in size tend to get caught in conventional engine oil filters. Dispersed phases below 5 nanometers in size typically require significantly larger amounts of emulsifier than dispersed phases of 50 or 500 nanometers. Therefore, the dispersed phases of base and optional oil insoluble solvent, e.g. water, desirably has a number and/or intensity average particle size by light scattering of 5 nanometers to 100 microns, more desirably from 5 nanometers to 20 microns, and preferably from about 10 nanometers to about 10 microns.

Further the base in this application is not an alkali or alkaline metal borate or hydrated alkali or alkaline metal borate as described in U.S. Pat. No. 3,853,772 and related patent documents on the use of borate compounds in lubricants.

DEFINITIONS

The term lower when used in conjunction with terms such as alkyl, alkenyl, and alkoxy is intended to describe such groups that contain a total of up to 7 carbon atoms.

The term water-soluble refers to materials that are soluble in water to the extent of at least one gram per 100 milliliters of water at 25° C.

The term lubricant or hydrocarbon lubricant soluble refers to materials that are soluble in a SAE 30 paraffinic base oil lubricant to the extent of at least one gram per 100 milliliters of lubricant at 25° C.

A material which is less soluble in SAE 30 paraffin oil than 1 g/100 mL of oil at 25° C. will be classified as oil insoluble.

Hydrocarbyl groups or substituents refers to a group having one or more carbon atoms directly attached to the remainder of the molecule having a hydrocarbon nature or predominantly so and includes 1) pure hydrocarbon groups (e.g. alkyl, alkenyl, alkylene, and cyclic materials), 2) substituted hydrocarbon groups, which are still predominantly hydrocarbon in nature (e.g. halo, hydroxyl, alkoxy, mercapto, alkylmercapto, nitro, nitroso, and sulfoxy), and 3) heterosubstituted hydrocarbon groups such as described in 2) with no more than 1 or 2 halogen, oxygen, sulfur, or nitrogen atoms or combinations per 10 carbon atoms.

The Emulsifier(s)

In one embodiment, the emulsifier used in accordance with the invention is an emulsifier composition which comprises: (i) a hydrocarbon lubricant-soluble product made by reacting a hydrocarbyl substituted carboxylic acid acylating agent with ammonia or an amine, the hydrocarbyl substituent of said acylating agent having about 50 to about 500 carbon atoms; (ii) an ionic or a nonionic compound having a hydrophilic lipophilic balance (HLB) of about 1 to about 30; a mixture of (i) and (ii); or a mixture of (i) and (ii) in combination with (iii) a water-soluble salt distinct from (i) and (ii). Mixtures of (i), (ii) are preferred. They are described in U.S. Pat. No. 6,383,237 (hereinafter U.S. Pat. No. '237) where they are described as fuel soluble rather than oil soluble, hereby incorporated by reference. This emulsifier composition is present in the lubricating oil compositions of the invention at a concentration of about 0.05 to about 20% by weight, and in one embodiment about 0.05 to about 10% by weight, and in one embodiment about 0.1 to about 5% by weight, and in one embodiment about 0.1 to about 3% by weight, and in one embodiment about 0.1 to about 2.5% by weight. Emulsifiers have been defined to distinguish them from overbased detergents and similar materials even though overbased detergents may have an effect on emulsion stability. It is also noted that dispersants, which are commonly used in lubricants, have some similarity to low HLB surfactants.

The hydrocarbyl-substituted carboxylic acid acylating agent for the hydrocarbon lubricant-soluble product (i) may be a carboxylic acid or a reactive equivalent of such acid. The reactive equivalent may be an acid halide, anhydride, or ester, including partial esters and the like. The hydrocarbyl substituent for the carboxylic acid acylating agent may contain from about 50 to about 300 or 500 carbon atoms, and in one embodiment about 60 to about 200 carbon atoms. In one embodiment, the hydrocarbyl substituent of the acylating agent has a number average molecular weight of about 500 or 750 to about 3000, and in one embodiment about 900 to about 2000 or 2300.

In one embodiment, the hydrocarbyl-substituted carboxylic acid acylating agent for the hydrocarbon lubricant-soluble product (i) may be made by reacting one or more alpha-beta olefinically unsaturated carboxylic acid reagents containing 2 to about 20 carbon atoms, exclusive of the carboxyl groups, with one or more olefin polymers as described more fully hereinafter. The alpha-beta olefinically unsaturated carboxylic acid reagents may be either monobasic or polybasic in nature. They are described in U.S. Pat. No. '237 in column 13.

The olefin monomers from which the olefin polymers may be derived are polymerizable olefin monomers characterized by having one or more ethylenic unsaturated groups and they (monomers and polymers) are described in U.S. Pat. No. '237 column 14.

In one embodiment, the olefin polymer is a polyisobutene group (or polyisobutylene group) having a number average molecular weight of about 750 to about 3000, and in one embodiment about 900 to about 2000.

In one embodiment, the acylating agent for the hydrocarbon lubricant-soluble product (i) is a hydrocarbyl-substituted succinic acid or anhydride represented correspondingly by the formulae

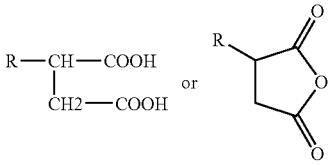

wherein R is hydrocarbyl group of about 50 to about 500 carbon atoms, and in one embodiment from about 50 to about 300, and in one embodiment from about 60 to about 200 carbon atoms. The production of these hydrocarbyl-substituted succinic acids or anhydrides via alkylation of maleic acid or anhydride or its derivatives with a halohydrocarbon or via reaction of maleic acid or anhydride with an olefin polymer having a terminal double bond is well known to those of skill in the art and need not be discussed in detail herein.

In one embodiment, the hydrocarbyl-substituted carboxylic acid acylating agent for the product hydrocarbon lubricant-soluble product (i) is a hydrocarbyl-substituted succinic acylating agent consisting of hydrocarbyl substituent groups and succinic groups. The hydrocarbyl substituent groups are derived from an olefin polymer as discussed above. The hydrocarbyl-substituted carboxylic acid acylating agent is characterized by the presence within its structure of an average of at least 1.3 succinic groups, and in one embodiment from about 1.5 to about 2.5, and in one embodiment form about 1.7 to about 2.1 succinic groups for each equivalent weight of the hydrocarbyl substituent. In one embodiment, the hydrocarbyl-substituted carboxylic acid acylating agent is characterized by the presence within its structure of about 1.0 to about 1.3, and in one embodiment from about 1.0 to about 1.2, and in one embodiment from about 1.0 to about 1.1 succinic groups for each equivalent weight of the hydrocarbyl substituent.

In one embodiment, the hydrocarbyl-substituted carboxylic acid acylating agent is a polyisobutene-substituted succinic anhydride, the polyisobutene substituent having a number average molecular weight of about 1500 to about 3000, and in one embodiment about 1800 to about 2300, said first polyisobutene-substituted succinic anhydride being characterized by about 1.3 to about 2.5, and in one embodiment about 1.7 to about 2.1 succinic groups per equivalent weight of the polyisobutene substituent.

In one embodiment, the hydrocarbyl-substituted carboxylic acid acylating agent is a polyisobutene-substituted succinic anhydride, the polyisobutene substituent having a number average molecular weight of about 700 to about 1300, and in one embodiment about 800 to about 1000, said polyisobutene-substituted succinic anhydride being characterized by about 1.0 to about 1.3, and in one embodiment about 1.0 to about 1.2 succinic groups per equivalent weight of the polyisobutene substituent. These are further described in U.S. Pat. No. '237 columns 15 and 16.

The hydrocarbon lubricant-soluble product (i) may be formed using ammonia and/or an amine. The amines useful for reacting with the acylating agent to form the product (i) include monoamines, polyamines, and mixtures thereof.

The monoamines have only one amine functionality whereas the polyamines have two or more. The amines may be primary, secondary or tertiary amines. The primary amines are characterized by the presence of at least one —$NH_2$ group; the secondary by the presence of at least one H—N< group. The tertiary amines are analogous to the primary and secondary amines with the exception that the hydrogen atoms in the —$NH_2$ or H—N< groups are replaced by hydrocarbyl groups. Examples of primary and secondary monoamines are in U.S. Pat. No. '237 column 16. The amines may be hydroxyamines. The hydroxyamines may be primary, secondary or tertiary amines. Typically, the hydroxamines are primary, secondary or tertiary alkanolamines. The alkanol amines may be represented by the formulae:

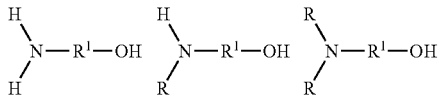

further described in U.S. Pat. No. '237 columns 16 and 17.

The amine may be an alkylene polyamine. Especially useful are the linear or branched alkylene polyamines represented by the formula

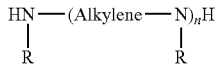

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines are described in U.S. Pat. No. '237 column 18. Ethylene polyamines are useful. In one embodiment, the amine is a polyamine bottoms or a heavy polyamine. The term "polyamine bottoms" refers to those polyamines resulting from the stripping of a polyamine mixture to remove lower molecular weight polyamines and volatile components to leave, as residue, the polyamine bottoms. In one embodiment, the polyamine bottoms are characterized as having less than about 2% by weight total diethylene triamine or triethylene tetramine. These are described in U.S. Pat. No. '237 in column 18.

The hydrocarbon lubricant-soluble product (i) may be a salt, an ester, an amide, an imide, or a combination thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. In one embodiment, the amine is a hydroxyamine, the hydrocarbyl-substituted carboxylic acid acylating agent is a hydrocarbyl-substituted succinic anhydride, and the resulting hydrocarbon lubricant-soluble product (i) is a half ester and half salt, i.e., an ester/salt. The reactions to form these products are in U.S. Pat. No. '237 in column 17.

Component (i)(b) is a hydrocarbon lubricant-soluble product made by reacting an acylating agent with at least one ethylene polyamine such as TEPA (tetraethylenepentamine), PEHA (pentaethylenehexamine), TETA (triethylenetetramine), polyamine bottoms, or at least one heavy polyamine. The ethylene polyamine can be condensed to form a succinimide. The equivalent ratio of the reaction for CO:N is from 1:1.5 to 1:0.5, more preferably from 1:1.3 to 1:0.70, and most preferably from 1:1 to 1:0.70, wherein CO:N is the carbonyl to amine nitrogen ratio. Also, component (i)(b) is preferably made from a polyisobutylene group having a number average molecular weight of from about 700 to about 1300 and that is succinated in the range from 1.0 up to 1.3.

The reaction between the hydrocarbyl-substituted carboxylic acid acylating agent and the ammonia or amine is carried out under conditions that provide for the formation of the desired product, which are set forth in U.S. Pat. No. '237 column 17. In one embodiment, the lubricant soluble product (i) comprises: (i)(a) a first lubricant-soluble product made by reacting a first hydrocarbyl-substituted carboxylic acid acylating agent with ammonia or an amine, the hydrocarbyl substituent of said first acylating agent having about 50 to about 500 carbon atoms; and (i)(b) a second lubricant-soluble product made by reacting a second hydrocarbyl-substituted carboxylic acid acylating agent with ammonia or an amine, the hydrocarbyl substituent of said second acylating agent having about 50 to about 500 carbon atoms. In this embodiment, the products (i)(a) and (i)(b) are different. For example, the molecular weight of the hydrocarbyl substituent for the first acylating agent may be different than the molecular weight of the hydrocarbyl substituent for the second acylating agent. In one embodiment, the number average molecular weight for the hydrocarbyl substituent for the first acylating agent may be in the range of about 1500 to about 3000, and in one embodiment about 1800 to about 2300, and the number average molecular weight for the hydrocarbyl substituent for the second acylating agent may be in the range of about 700 to about 1300, and in one embodiment about 800 to about 1000. The first hydrocarbyl-substituted carboxylic acid acylating agent may be a polyisobutene-substituted succinic anhydride, the polyisobutene substituent having a number average molecular weight of about 1500 to about 3000, and in one embodiment about 1800 to about 2300. This first polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The amine used in this first lubricant-soluble product (i)(a) may be an alkanol amine and the product may be in the form of an ester/salt. The second hydrocarbyl-substituted carboxylic acid acylating agent may be a polyisobutene-substituted succinic anhydride, the polyisobutene substituent of said second polyisobutene-substituted succinic anhydride having a number average molecular weight of about 700 to about 1300, and in one embodiment about 800 to about 1000. This second polyisobutene-substituted succinic anhydride may be characterized by about 1.0 to about 1.3, and in one embodiment about 1.0 to about 1.2 succinic groups per equivalent weight of the polyisobutene substituent. The amine used in this second lubricant-soluble product (i)(b) may be an alkanol amine and the product may be in the form of an ester/salt, or the amine may be an alkylene polyamine and the product may be in the form of a succinimide. The lubricant-soluble product (i) may be comprised of: about 1% to about 99% by weight, and in one embodiment about 30% to about 70% by weight of the product (i)(a); and about 99% to about 1% by weight, and in one embodiment about 70% to about 30% by weight of the product (i)(b).

In one embodiment, the lubricant soluble product (i) comprises: (i)(a) a first hydrocarbyl-substituted carboxylic acid acylating agent, the hydrocarbyl substituent of said first acylating agent having about 50 to about 500 carbon atoms; and (i)(b) a second hydrocarbyl-substituted carboxylic acid acylating agent, the hydrocarbyl substituent of said second acylating agent having about 50 to about 500 carbon atoms, said first acylating agent and said second acylating agent being the same or different; said first acylating agent and said second acylating agent being coupled together by a linking group derived from a compound having two or more primary amino groups, two or more secondary amino groups, at least one primary amino group and at least one secondary amino group, at least two hydroxyl groups, or at least one primary or secondary amino group and at least one hydroxyl group; said coupled acylating agents being reacted with ammonia or an amine. The molecular weight of the hydrocarbyl substituent for the first acylating agent may be the same as or it may be different than the molecular weight of the hydrocarbyl substituent for the second acylating agent.

In one embodiment, the number average molecular weight for the hydrocarbyl substituent for the first and/or second acylating agent is in the range of about 1500 to about 3000, and in one embodiment about 1800 to about 2300.

In one embodiment, the number average molecular weight for the hydrocarbyl substituent for the first and/or second acylating agent is in the range of about 700 to about 1300, and in one embodiment about 800 to about 1000. The first and/or second hydrocarbyl-substituted carboxylic acid acylating agent may be a polyisobutene-substituted succinic anhydride, the polyisobutene substituent having a number average molecular weight of about 1500 to about 3000, and in one embodiment about 1800 to about 2300. This first and/or second polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The first and/or second hydrocarbyl-substituted carboxylic acid acylating agent may be a polyisobutene-substituted succinic anhydride, the polyisobutene substituent having a number average molecular weight of about 700 to about 1300, and in one embodiment about 800 to about 1000. This first and/or second polyisobutene-substituted succinic anhydride may be characterized by about 1.0 to about 1.3, and in one embodiment about 1.0 to about 1.2 succinic groups per equivalent weight of the polyisobutene substituent. The linking group may be derived from any of the amines or hydroxamines discussed above having two or more primary amino groups, two or more secondary amino groups, at least one primary amino group and at least one secondary amino group, or at least one primary or secondary amino group and at least one hydroxyl group. The linking group may also be derived from a polyol. The polyol may be a compound represented in U.S. Pat. No. '237 column 20.

The ratio of reactants utilized in the preparation of these linked products may be varied over a wide range. Generally, for each equivalent of each of the first and second acylating agents, at least about one equivalent of the linking compound is used. The upper limit of linking compound is about two equivalents of linking compound for each equivalent of the first and second acylating agents. Generally the ratio of equivalents of the first acylating agent to the second acylating agent is about 4:1 to about 1:4, and in one embodiment about 1.5:1.

The first and second acylating agents may be reacted with the linking compound according to conventional ester and/or amide-forming techniques. This normally involves heating acylating agents with the linking compound, optionally in the presence of a normally liquid, substantially inert, organic liquid solvent/diluent. The reaction between the linked acylating agents and the ammonia or amine may be carried out under salt, ester/salt, amide or imide forming conditions using conventional techniques.

The hydrocarbon lubricant soluble product (i) may be present in the aqueous hydrocarbon lubricant compositions of the invention at a concentration of about 0.1 to about 15% by weight, and an one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The ionic or nonionic compound (ii) has a hydrophilic lipophilic balance (HLB) in the range of about 1 to about 20 or 30, and in one embodiment about 4 to about 15 or 20. Examples of these compounds are disclosed in *McCutcheon's Emulsifiers and Detergents,* 1998, North American & International Edition. Pages 1-235 of the North American Edition and pages 1-199 of the International Edition are incorporated herein by reference for their disclosure of such ionic and nonionic compounds having an HLB in the range of about 1 to about 10 or 30. These are set forth in U.S. Pat. No. '237 column 27. In one embodiment, the ionic or nonionic compound (ii) is a poly(oxyalkene) compound. These include copolymers of ethylene oxide and propylene oxide. In one embodiment, the ionic or nonionic compound (ii) is a hydrocarbon lubricant-soluble product made by reacting an acylating agent having about 12 to about 30 carbon atoms with ammonia or an amine. The acylating agent may contain about 12 to about 24 carbon atoms, and in one embodiment about 12 to about 18 carbon atoms. These are set forth in U.S. Pat. No. '237 column 27. The amine may be any of the amines described above as being useful in making the hydrocarbon lubricant-soluble product (i). The product of the reaction between the acylating agent and the ammonia or amine may be a salt, an ester, an amide, an imide, or a combination thereof.

In one embodiment, the ionic or nonionic compound (ii) is an ester/salt made by reacting hexadecyl succinic anhydride with dimethylethanolamine in an equivalent ratio (i.e., carbonyl to amine ratio) of about 1:1 to about 1:1.5, and in one embodiment about 1:1.35.

In one embodiment, the ionic or nonionic compound can be the reaction product of a copolymer of an alpha olefin of 3 to 25 carbon atoms with maleic anhydride reacted with an amine (as previously described). One such reaction product would be a copolymer of octadecene with maleic anhydride that is reacted with triethylene-tetramine. It may be desirable to control crosslinking with these multifunctional reactants by having large amounts of carboxylic acids of lower functionality and/or amines of lower functionality present to avoid forming an insoluble product.

The ionic or nonionic compound (ii) may be present in the aqueous hydrocarbon fuel compositions of the invention at a concentration of about 0.01 to about 15% by weight, and in one embodiment about 0.01 to about 10% by weight, and one embodiment about 0.01 to about 5% by weight, and in one embodiment about 0.01 to about 3% by weight, and in one embodiment about 0.1 to about 1% by weight.

The water-soluble salt (iii) may be any material capable of forming positive and negative ions in an aqueous solution that does not interfere with the other additives. These include organic amine nitrates, nitrate esters, azides, nitramines, and nitro compounds. Also included are alkali and alkaline earth metal carbonates, sulfates, sulfides, sulfonates, and the like. Particularly useful are the amine or ammonium salts represented by the formula $$k[G(NR_3)_y]^{y+}nX^{p-}$$

wherein G is hydrogen or an organic group of 1 to about 8 carbon atoms, and in one embodiment 1 to about 2 carbon atoms, having a valence of y; each R independently is hydrogen or a hydrocarbyl group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, ammonium acetate, methylammonium nitrate, methylammonium acetate, ethylene diamine diacetate, urea nitrate, urea, guanidinium nitrate, and urea dinitrate. Ammonium nitrate is particularly useful.

In one embodiment, the water-soluble salt (iii) functions as an emulsion stabilizer, i.e., it acts to stabilize the aqueous hydrocarbon lubricant compositions.

In one embodiment the water soluble salt may be present in the water-lubricant emulsion at a concentration of about 0.001 to about 1% by weight, and in one embodiment from about 0.01 to about 1% by weight. In many embodiments the water soluble salt is absent or serves as a different component, such as the water soluble or water dispersible base.

Conventional Detergents

A detergent is an additive that reduces formation of piston deposits, for example high-temperature varnish and lacquer deposits, in engines; it normally has acid-neutralizing properties and is capable of keeping finely divided solids in suspension. Most detergents are based on metal "soaps", that is metal salts of acidic organic compounds, is sometimes referred to as surfactants.

Detergents generally comprise a polar head with a long hydrophobic tail, the polar head comprising a metal salt of an acidic organic compound. The detergents in this invention can be low TBN (<200 mg KOH/g) in which the surfactants are neutralized with base to form metal soaps. Alternatively, they can be overbased detergents in which large amounts of a metal base are included by reacting an excess of a metal compound, such as an oxide or hydroxide, with an acidic gas such as carbon dioxide to give an overbased detergent which comprises neutralized detergent as the outer layer of a metal base (e.g. carbonate) micelle. The overbased detergents of this invention may have a TBN of at least 200, preferably at least 250, especially at least 300, such as up to 600.

Surfactants that may be used include sulfonates, phenates, sulfurized phenates, salicylates, calixarates, salicylic calixarenes, glyoxylates, saligenins, thiophosphonates, naphthenates, other oil-soluble carboxylates, or mixtures of any of these surfactants. Sulfurized phenates are preferred. The metal may be an alkali or alkaline earth metal, e.g., sodium, potassium, lithium, calcium, and magnesium. Calcium is preferred.

Surfactants for the surfactant system of the overbased metal compounds preferably contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impart the desired oil-solubility.

These overbased salts can be of oil-soluble organic sulfur acids such as sulfonic, sulfamic, thiosulfonic, sulfinic, sulfonic, partial ester sulfuric, sulfurous and thiosulfuric acid. Generally they are salts of carbocylic or aliphatic sulfonic acids.

The carbocylic sulfonic acids include the mono- or polynuclear aromatic or cycloaliphatic compounds. The oil-soluble sulfonates can be represented for the most part by the following formulae:

$$[(R^{11})_x—T—(SO_3)_y]_zM_b \quad \text{(XIV)}$$

$$[R^{12}—(SO_3)_a]_dM_b \quad \text{(XV)}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.; $R^{11}$ in Formula XIV is an aliphatic group such as alkyl, alkenyl, alkoxy, alkoxyalkyl, carboalkoxyalkyl, etc.; x is at least 1, and $(R^{11})_x$—T contains a total of at least about 15 carbon atoms, $R^{12}$ in Formula XV is an aliphatic radical containing at least about 15 carbon atoms and M is either a metal cation or hydrogen. Examples of the type of the $R^{12}$ radical are alkyl, alkenyl, alkoxyalkyl, carboalkoxyalkyl, etc. Specific examples of $R^{12}$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^{11}$ and $R^{12}$ in the above formulae can also contain other inorganic or organic substituents in addition to those enumerated above such as, for example, hydroxy, mercapto, halogen, nitro, amino, nitroso, sulfide, disulfide, etc. In Formula XIV, x, y, z and b are at least 1, and likewise in Formula XV, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which as been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology," Second Edition, Vol. 19, pp. 291 at seq. published by John Wiley & Sons, N.Y. (1969).

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790 and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl)cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

The terminology "metal ratio" is used to designate the ratio of the total chemical equivalents of the metal in the overbased salt to the chemical equivalents of the metal in the salt which would be expected to result in the reaction between the organic acid to be overbased and the basic reacting metal compound according to the known chemical reactivity and stoichiometry of the two reactants. Thus, in a normal or neutral salt the metal ratio is one and, in an overbased salt, the metal ratio is greater than one. The overbased salts usually have metal ratios of at least 1.1:1. Typically they have ratios of 2:1 or 3:1 to 40:1. Salts having ratios of 12:1 to 20:1 are often used.

The basically reacting metal compounds used to make the overbased salts are usually an alkali or alkaline earth metal compound (i.e., the Group IA, IIA, and IIB metals, but normally excluding francium and radium and typically also excluding rubidium, cesium and beryllium), although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art referred to herein. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the functionalize alkyl phenol.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, and in one embodiment, $CO_2$ or mixtures thereof, e.g., mixtures of $CO_2$ and acetic acid.

A promoter is a chemical employed to facilitate the incorporation of metal into the basic metal compositions. The promoters are diverse and are well known in the art and include lower alcohols. A discussion of suitable promoters is found in U.S. Pat. Nos. 2,777,874, 2,695,910, and 2,616,904.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Phenate surfactants for use in this invention, may be non-sulfurized or, preferably, sulfurized. Further, phenate includes those containing more than one hydroxyl group (for example, from alkyl catechols) or fused aromatic rings (for example, alkyl naphthols) and those which have been modified by chemical reaction, for example, alkylene-bridged and Mannich base-condensed and saligenin-type (produced by the reaction of a phenol and an aldehyde under basic conditions).

Preferred, phenols on which the phenate surfactants are based may be derived from the formula I below:

Formula I

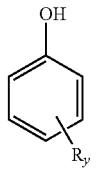

where R represents a hydrocarbyl group and y represents 1 to 4. Where y is greater than 1, the hydrocarbyl groups may be the same or different.

The phenols are frequently used in sulfurized form. Sulfurized hydrocarbyl phenols may typically be represented by the formula 11 below:

Formula II

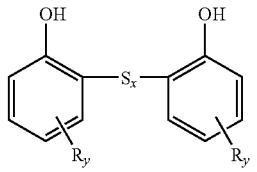

where x is generally from 1 to 4. In some cases, more than two phenol molecules may be linked by Sx, bridges.

In the above formulae, hydrocarbyl groups represented by R are advantageously alkyl groups, which advantageously contain 5 to 100, preferably 5 to 40, especially 9 to 12, carbon atoms, the average number of carbon atoms in all of-the R groups being at least about 9 in order to ensure adequate solubility in oil. Preferred alkyl groups are dodecyl (tetrapropylene) groups.

In the following discussion, hydrocarbyl-substituted phenols will for convenience be referred to as alkyl phenols.

A sulfurizing agent for use in preparing a sulfurized phenol or phenate may be any compound or element which Introduces —(S)x- bridging groups between the alkyl phenol monomer groups, wherein x is generally from 1 to about 4. Thus, the reaction may be conducted with elemental sulfur or a halide thereof, for example sulfur dichloride or more preferably, sulfur monochloride. If elemental sulfur is used, the sulfurization reaction may be effected by heating the alkyl phenol compound at from 50 to 250, preferably at least 100° C. The use of elemental sulfur will typically yield a mixture of bridging groups —(S)X— as described above. If a sulfur halide is used, the sulfurization reaction may be effected by treating the alkyl phenol at from −10 to 120, preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulfur is used as the sulfurizing agent, it may be desirable to use a basic catalyst, for example, sodium hydroxide or an organic amine, preferably a heterocyclic amine (e.g., morpholine).

Details of sulfurization processes are well known to those skilled in the art.

Regardless of the manner in which they are prepared, sulfurized alkyl phenols useful in preparing overbased metal compounds generally comprise diluent and unreacted alkyl phenols and generally contain from 2 to 20, preferably 4 to 14, most preferably 6 to 12, mass % of sulfur, based on the mass of the sulfurized alkyl phenol.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described In GB-A-2 121 432.

In general, the phenols may include substituents other than those mentioned above provided that such substituents do not detract significantly from the surfactant properties of the phenols. Examples of such substituents are methoxy groups and halogen atoms.

The functionalization of the alkyl phenol can comprise the addition of any functional group to the phenolic compound, other than an additional hydroxy group or an additional hydrocarbyl group, at least one such alkyl or hydrocarbyl group already being present in sufficient amount to provide oil solubility to the detergent. Typical functional groups include t-butyl groups, methylene coupling groups, ester-substituted alkyl groups, and aldehyde groups. In one embodiment the functionalization is by addition of carboxy functionality, in which case the detergent can be an alkyl salicylate or a derivative thereof. Salicylate detergents are well known; see, for instance, U.S. Pat. No. 5,688,751 or 4,627,928. In another embodiment, the substituent can be based on a glyoxylic acid condensation. Glyoxylic acid itself is HC(=O)—$CO_2H$; related ketones of the structure $R^1C$(=O)—$CO_2H$ are also contemplated; thus $R^1$ can be hydrogen or a hydrocarbyl group of, for instance, 1 to 20 carbon atoms. A typical glyoxylate condensation product is shown here as an anionic species, which will typically be neutralized with a metal salt.

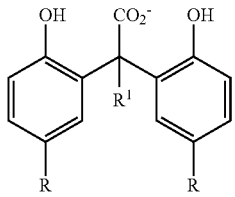

In this structure, the R groups are alkyl groups. The material shown would be the condensation of 2 moles of alkyl phenol with 1 mole of glyoxylic acid or derivative thereof. Other molar ratios are also possible; when a 1:1 ratio is approached, the condensation product becomes oligomeric or polymeric. These materials and methods for their preparation are disclosed in greater detail in U.S. Pat. No. 5,356,546.

In other embodiments the functionalized alkyl phenol can be a condensation product of the alkyl phenol with formaldehyde or other lower aldehydes. The acidic substituent, in this case, would be considered to be the one or more additional phenolic groups. The simplest such condensation product would be

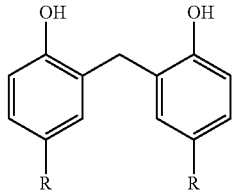

shown here as the 2:1 molar condensate of phenol:formaldehyde. Also, depending on the conditions of reaction, the formaldehyde unit may appear in other oxidation states. As in the case of glyoxylates, oligomeric structures can be formed when the molar ratio of formaldehyde:phenol increases. Examples of such type of oligomeric species are the calixarates, which are cyclic materials containing 4 to 8 phenol-formaldehyde repeat units. Calixarates and methods of their preparation are disclosed in greater detail in U.S. Pat. No. 5,114,601. As will be apparent, mixtures of formaldehyde, other aldehydes, and glyoxylic acid can also be employed in such condensation reactions.

One category of functionalized derivatives of alkyl phenols, however, is certain saligenin derivatives. Saligenin itself, also known as salicyl alcohol and o-hydroxybenzyl alcohol, is represented by the structure

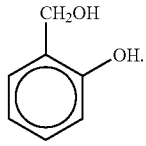

Useful saligenin derivatives include certain metal saligenin derivative which function as detergents. When the metal is magnesium, these compounds can be represented by the formula

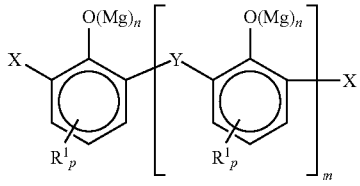

This represents generally a metal salt, such as a magnesium salt, of a compound containing one aromatic ring or a multiplicity of aromatic rings linked by "Y" groups, and also containing "X" groups. (Mg) represents a valence of a magnesium ion, and n, in each instance, is 0 or 1. (When n is zero the Mg is typically replaced by H to form an —OH group.) The value for "m" is typically 0 to 10, so number of such rings will be 1 to 11, although it is to be understood that the upper limit of "m" is not a critical variable. In one embodiment m is 2 to 9, such as 3 to 8 or 4 to 6. Other metals include alkali metals such as lithium, sodium, or potassium; alkaline earth metals such as calcium or barium; and other metals such as copper, zinc, and tin.

Most of the rings contain at least one $R^1$ substituent, which is the aforementioned hydrocarbyl group, such as alkyl group. $R^1$ can contain 1 to 60 carbon atoms, such as 7 to 28 carbon atoms or 9 to 18 carbon atoms. Of course it is understood that $R^1$ will normally comprise a mixture of various chain lengths, so that the foregoing numbers will normally represent an average number of carbon atoms in the $R^1$ groups (number average). Each ring in the structure will be substituted with 0, 1, 2, or 3 such $R^1$ groups (that is, p is 0, 1, 2, or 3), most typically 1, and of course different rings in a given molecule may contain different numbers of such substituents. At least one aromatic ring in the molecule must contain at least one $R^1$ group, and the total number of carbon atoms in all the $R^1$ groups in the molecule should be at least 7, such as at least 12.

In the above structure the X and Y groups may be seen as groups derived from formaldehyde or a formaldehyde source, by condensative reaction with the aromatic molecule. The relative amounts of the various X and Y groups depends to a certain extent on the conditions of synthesis of the molecules. While various species of X and Y may be present in the molecules in question, the commonest species comprising X are —CHO (aldehyde functionality) and —$CH_2OH$ (hydroxymethyl functionality); similarly the commonest species comprising Y are —$CH_2$— (methylene bridge) and —$CH_2OCH_2$— (ether bridge). The relative molar amounts of these species in a sample of the above material can be determined by $^1H/^{13}C$ NMR as each carbon and hydrogen nucleus has a distinctive environment and produces a distinctive signal. (The signal for the ether linkage, —$CH_2OCH_2$— must be corrected for the presence of two carbon atoms, in order to arrive at a correct calculation of the molar amount of this material. Such a correction is well within the abilities of the person skilled in the art.)

In one embodiment, X is at least in part —CHO and such —CHO groups comprise at least 10, 12, or 15 mole percent of the X and Y groups. In another embodiment the —CHO groups comprise 20 to 60 mole percent of the X and Y groups, such as 25 to 40 mole percent of the X and Y groups.

In another embodiment, X is at least in part —$CH_2OH$ and such —$CH_2OH$ groups comprise 10 to 50 mole percent of the X and Y groups, such as 15 to 30 mole percent of the X and Y groups.

In an embodiment in which m is non-zero, Y is at least in part —$CH_2$— and such —$CH_2$— groups comprise 10 to 55 mole percent of the X and Y groups, such as 25 to 45 or 32 to 45 mole percent of the X and Y groups.

In another embodiment Y is at least in part —$CH_2OCH_2$— and such —$CH_2OCH_2$— groups comprise 5 to 20 mole percent of the X and Y groups, such as 10 to 16 mole percent of the X and Y groups.

The above-described compound is, as mentioned, typically a magnesium salt and, indeed, the presence of magnesium during the preparation of the condensed product is believed to be useful in achieving the desired ratios of X and Y components described above. The number of Mg ions in the compound is characterized by an average value of "n" of 0.1 to 1 throughout the composition, such as 0.2 or 0.3 to 0.4 or 0.5, or 0.35 to 0.45. Since Mg is normally a divalent ion, when all of the phenolic structures shown are entirely neutralized by $Mg^{+2}$ ions, the average value of n in the composition will be 0.5, that is, each Mg ion neutralizes 2 phenolic hydroxy groups. Those two hydroxy groups may be on the same or on different molecules. If the value of n is less than 0.5, this indicates that the hydroxy groups are less than completely neutralized by Mg ions. If the value of n is greater than 0.5, this indicates that a portion of the valence of the Mg ions is satisfied by an anion other than the phenolic structure shown. For example each Mg ion could be associated with one phenolic anion and one hydroxy ($OH^-$) ion, to provide an n value of 1.0. The specification that n is 0.1 to 1.0 is not directly applicable to overbased versions of this material (described below and also a part of the present invention) in which an excess of Mg or another metal can be present.

It is understood that in a sample of a large number of molecules, some individual molecules may exist which deviate from these parameters, for instance, there may be some molecules containing no $R^1$ groups whatsoever. These molecules could be considered as impurities, and their presence will not negate the present invention so long as the majority (and generally the substantial majority) of the molecules of the composition are as described.

The above-described component can be prepared by combining a phenol substituted by the above-described $R^1$ group with formaldehyde or a source of formaldehyde and magnesium oxide or magnesium hydroxide under reactive conditions, in the presence of a catalytic amount of a strong base. Common reactive equivalents of formaldehyde includes paraformaldehyde, trioxane, and formalin For convenience, paraformaldehyde is can be used.

The relative molar amounts of the substituted phenol and the formaldehyde can be important in providing products with the desired structure and properties. In a typical embodiment, the substituted phenol and formaldehyde are reacted in equivalent ratios of 1:1 to 1:3 or 1.4, such as 1:1.1 to 1:2.9 or 1:1.4 to 1:2.6, or 1:1.7 to 1:2.3. Thus in one embodiment there will be about a 2:1 equivalent excess of formaldehyde. (One equivalent of formaldehyde is considered to correspond to one $H_2CO$ unit; one equivalent of phenol is considered to be one mole of phenol.)

The strong base can be sodium hydroxide or potassium hydroxide, and can be supplied in an aqueous solution.

The process can be conducted by combining the above components with an appropriate amount of magnesium oxide or magnesium hydroxide with heating and stirring. A diluent such as mineral oil or other diluent oil can be included to provide for suitable mobility of the components. An additional solvent such as an alcohol can be included if desired, although it is believed that the reaction may proceed more efficiently in the absence of additional solvent. The reaction can be conducted at room temperature or at a slightly elevated temperature such as 35-120° C., 70-110° C., or 90-100° C., and of course the temperature can be increased in stages. When water is present in the reaction mixture it is convenient to maintain the mixture at or below the normal boiling point of water. After reaction for a suitable time (e.g., 30 minutes to 5 hours or 1 to 3 hours) the mixture can be heated to a higher temperature, typically under reduced pressure, to strip off volatile materials. Favorable results are obtained when the final temperature of this stripping step is 100 to about 150° C., such as 120 to about 145° C.

Reaction under the conditions described above typically leads to a product which has a relatively high content of —CHO substituent groups, that is, 10%, 12%, and even 15% and greater. Such materials, when used as detergents in lubricating compositions, exhibit good upper piston cleanliness performance, low Cu/Pb corrosion, and good compatibility with seals. Use of metals other than magnesium in the synthesis typically leads to a reduction in the content of —CHO substituent groups.

Salicylate surfactants used in accordance with the invention may be non-sulfurized or sulfurized, and may be chemically modified and/or contain additional substituents, for example, as discussed below for phenates. Processes similar to those described below may also be used for sulfurizing a hydrocarbyl-substituted salicylic acid, and are well known to those skilled in the art. Salicylic acids are typically prepared by the carboxylation, by the Kolbe-Schmit process, of phenoxides, and in that case, will generally be obtained (normally in a diluent) in admixture with uncarboxylated phenol.

Calixarates such as salixarenes i.e. salicylic calixarenes are also useful compounds to add as surfactants to lubricating oils. Salicylic calixarenes useful in this invention include those described in U.S. Pat. No. 6,200,936B1 to the Lubrizol Corporation hereby incorporated by reference for its teachings.

Preferred substituents in oil-soluble salicylic, acids from which salicylates in accordance with the invention may be derived are the substituents represented by R in the discussion below of phenols. In alkyl-substituted salicylic acids, the alkyl groups advantageously contain 5 to 100, preferably 9 to 30, especially 12 to 20, carbon atoms.

Oil of Lubricating Viscosity

The lubricating oils used may vary significantly depending on the final use of the oil. SAE 5 or 10 to about 70 are typical of the oils used in various internal combustion engines of various designs. Marine diesel applications typically call for the higher viscosity oils to provide a thicker lubricating film. While multigrade oils are desirable where the oil needs to provide lubrication at higher use temperatures along with low energy consumption at cold starting temperatures, marine diesel applications tend to use a single grade oil because the engines are subject to minimal cycling on and off and run for extended periods of time when operational. If a multigrade oil is used, desirably it has a viscosity index of at least 90, more desirably at least 100 and preferably at least 110. Desirably the lubricating oil basestock for marine diesel applications has a kinematic viscosity at 100 C (as measured by ASTM D445) of at least 14 centistokes, preferably at least 15 centistokes, more preferably in the range of from 16 to 30 centistokes, for example from 16 to 25 centistokes.

The lubricating oil can be any conventional oil or blends thereof used in internal combustion engines for a lubricant. Often for cost reasons the oil is a petroleum derived lubricating oil (e.g. distillation products), such as a naphthenic base, paraffinic base or a mixed base oil. The lubricant depending on the application may be a blend of petroleum derived oils and synthetic oils. Alternatively the lubricating oil may be a synthetic lubricating oils such as synthetic ester lubricating oils. Other lubricating oils that can be used are hydrocracked oils where the refining process further breaks down the middle and heavy distillate fractions in the presence of hydrogen. Liquid alpha olefin polymers may also be part or all of the lubricant. Fischer-Tropsch oils can be used in the lubricant. Brightstock, typically characterized as solvent-extracted, de-asphalted products from vacuum residuum, typically having a kinematic viscosity at 100° C. of from 28-36 centistokes may also be used.

The lubricant of the invention also can include conventional additives like detergents, dispersants, viscosity modifiers, antioxidants, extreme pressure additives (antiwear additives), foam inhibitors, corrosion inhibitors, etc. that are well known to the lubricant art. These additives can be used in conventional amounts.

In one embodiment, the lubricant of the invention contains an antifreeze agent to prevent freezing of the water component. The antifreeze agent is typically an alcohol. Examples include but are not limited to ethylene glycol, propylene glycol, methanol, ethanol, glycerol and mixtures of two or more thereof. The antifreeze agent is typically used at a concentration sufficient to prevent freezing of the water used in the lubricant. The concentration is therefore dependent upon the temperature at which the lubricant is stored or used. In one embodiment, the concentration is at a level of up to about 20% by weight based on the weight of the water-fuel emulsion, and in one embodiment about 0.1 to about 20% by weight, and in one embodiment about 0.2 to about 10% by weight.

As shown in the following examples the use of water soluble bases such as KOH in a lubricating oil does not result in any significant instability problems for the bases when the temperature of the oil exceeds 100° C. where the water may be evaporating at a fairly rapid rate and the total amount of water may be significantly less than the amount in the formulation.

Marine cylinder lubricants are used in marine engines including two stroke marine engines in order to provide lubricity, antioxidancy, high temperature detergency and neutralisation of sulphuric acid formed during the combustion. Traditional formulations use overbased detergents for acid neutralisation. The following examples describe a water in lubricant oil emulsion, which uses KOH dissolved in the water phase. KOH is a widely used and non-expensive base. KOH could neutralise the acids formed during the combustion in a more efficient way than the overbased detergents, which would improve the efficiency of the marine cylinder lubricant and reduce the cost of the formulation. The examples also describe the emulsifiers used for the preparation of the water in oil emulsion. These emulsifiers could also contribute to the high temperature detergency.

Soluble Base Examples

Water in oil emulsions containing ~20% w/w KOH aqueous solution (35% KOH w/w) and ~80% w/w oil formulation were prepared. The oil formulation contains 1-2% w/w emulsifying surfactants, ~2% w/w dispersant, ~3% w/w antioxidant, ~1% w/w aliphatic solvent and 92-93% w/w SAE-50 oil.

The emulsifiers play an important role in the emulsion preparation and storage stability. The first emulsifier of a blend of two emulsifiers used to prepare the examples was a PIBSA:EG:DMEA, polyisobutenyl succinic anhydride:ethylene glycol:dimethyl ethanol amine—2:1:2 (eq). This emulsifier has a high molecular weight polyisobutylene chain (~1500 MW) and a low HLB. Emulsifier two was a co-emulsifier. HDSA:DMEA, dodecahexylene succinic anhydride:dimethyl ethanolamine 1:1 (eq.). It has a low molecular weight and a high HLB. The structures of these two emulsifiers are presented below.

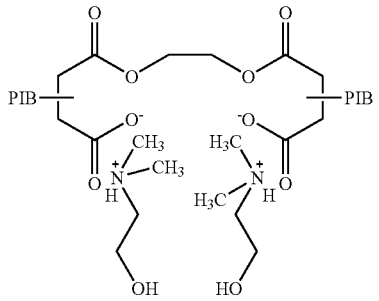

PIBSA:EG:DMEA
(≈2:1:2 (eq))

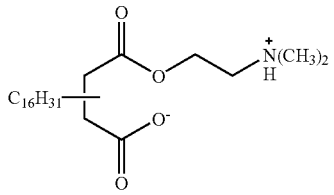

HDSA:DMEA
(≈1:1 (eq))

Emulsifiers Used in the Laboratory Manufacture of Water/Marine Lubricating Oil Emulsion The emulsifiers can be either dosed through an emulsifying concentrate or could be directly dissolved in the SAE-50 oil. Other emulsifiers could be used for the preparation of water/marine lubricating oil emulsions. The water/marine lubricating oil emulsion generally also contain a dispersant, like PIBSA:TEPA, a polyisobutenyl succinic anhydride:tetraethylene pentaamine—3:1 eq and an antioxidant, like calcium dodecyl phenate sulphide.

An example of emulsion composition is presented in Table 1.

TABLE 1

Example of water/marine lubricating oil emulsion

| Ingredient | Deionized water based emulsion % w/w | Sea-water based emulsion % w/w |
|---|---|---|
| KOH | 7.00 | 7.00 |
| Deionised water | 13.00 | 0.00 |
| Synthetic sea water | 0.00 | 13.00 |
| C9-C16 de-aromatized petroleum distillate | 1.12 | 1.12 |
| HDSA:DMEA | 0.31 | 0.31 |
| PIBSA:EG:DMEA | 1.19 | 1.19 |
| Nominally 1000 MW polyisobutylene grafted onto succinic anhydride (PIBSA) and further reacted with a mixed tetraethylenepentamine (TEPA) to form an imide PIBSA:TEPA = 3:1 (eq) A dispersant | 1.67 | 1.67 |
| Calcium dodecyl phenate sulphide | 2.74 | 2.74 |
| SAE-50 oil | 72.97 | 72.97 |

TABLE 2

Sea-water Composition ASTM D665-98)

| Sea-water Ingredients | (g/l) |
|---|---|
| NaCl | 24.54 |
| $MgCl_2.6H_2O$ | 11.10 |
| $Na_2SO_4$ | 4.09 |
| $CaCl_2$ | 1.16 |
| KCl | 0.69 |
| $NaHCO_3$ | 0.20 |
| KBr | 0.10 |
| $H_3BO_3$ | 0.03 |

TABLE 2-continued

Sea-water Composition ASTM D665-98)

| Sea-water Ingredients | (g/l) |
|---|---|
| $SrCl_2.6H_2O$ | 0.04 |
| NaF | 0.003 |

The potassium hydroxide solution is prepared by dissolving 35 g KOH pellets into 75 g of deionized water. This solution is not saturated. Synthetic sea-water can be used instead of deionized water (prepared as per ASTM D665-98) but then the solution becomes saturated at this concentration of KOH.

The water/marine lubricating oil emulsions can be prepared either i) via a concentrate, which contains a solvent and two emulsifiers or ii) via a method which uses the solvent and emulsifiers dissolved in the oil. Initial samples were prepared via a concentrate while later samples were prepared using a solvent and the emulsifier dissolved in the oil.

i) An emulsifying concentrate was prepared by mixing the two surfactants with a suitable aliphatic solvent. This concentrate was then mixed until homogeneous with the oil, which contains a dispersant and an antioxidant. The concentrate+oil mixture were weighed into a beaker to which KOH solution was added. The mixture was then sheared for 3-6 minutes using a high shear device, such as a Silverson or a Turrax mixer.

ii) The emulsifying surfactants and aliphatic solvent can be mixed with the oil, dispersant and anti-oxidant to form an oil formulation. This oil formulation is weighed into a beaker to which KOH solution is added. The mixture is then sheared for 3-6 minutes using a high shear device, such as a Silverson or a Turrax mixer (e.g. rotor stator).

Emulsion Stability

Water/marine lubricating oil emulsions were stored at room temperature and 65° C. in order to assess their stability against separation into a water phase and an oil phase over time. Stability was assessed after 7 days at room temperature, 7 days at 65° C., 28 days at room temperature and 28 days at 65° C. Emulsion stability was semi-quantitatively evaluated by % v/v separation of oil, oily emulsion, band and water. The presence of a separated water phase is considered particularly detrimental. Examples for emulsion stability are shown below. The emulsion ratings are reported after 7 and 28 days at room temperature and 65° C.

TABLE 3

Emulsion Storage Stability

| Emulsion | Emulsifying surfactants (% w/w in emulsion) | Oily | Oil | Band | Water | Oily | Oil | Band | Water |
|---|---|---|---|---|---|---|---|---|---|
| | | 7 days at room temperature (% v/v) | | | | 7 days at 65° C. (% v/v) | | | |
| Prepared with deionized water | 1.50 | 0 | 0 | 0 | 0 | 1 | 2 | 2 | 0 |

TABLE 3-continued

| Emulsion | Emulsifying surfactants (% w/w in emulsion) | Oily | Oil | Band | Water | Oily | Oil | Band | Water |
|---|---|---|---|---|---|---|---|---|---|
| | | Emulsion Storage Stability | | | | | | | |
| Prepared with synthetic sea-water | 1.50 | 1 | 0 | 0 | 0 | 2 | 0 | 18 | 0 |
| | | 28 days at room temperature (% v/v) | | | | 28 days at 65° C. (% v/v) | | | |
| Prepared with deionized water | 1.50 | 0 | 2 | 1 | 0 | 2 | 4 | 2 | 0 |

Oily = oil rich phase;
oil = clear oil;
band = coarse emulsion, results from the sedimentation of emulsion particles A series of tests were performed on water/marine lubricating oil emulsions in order to assess their behaviour at high temperatures and when in contact with sulfuric acid.

High Temperature Behaviour

In practice, traditional marine cylinder lubricants experience temperatures of 100-300° C., when in contact with the cylinder walls. The behaviour of water/marine lubricating oil emulsion at high temperatures was tested using the test cell shown in FIG. 4. This test cell consists of a heater finger, which can be heated up to 350° C. using a Eurotherm. A stainless steel panel fitted on the heater finger. The panel and heater finger are placed in a glass cell. The formulation to be tested was dosed at the required rate onto the heated panel with the help of a small tube attached to a peristaltic pump.

The behaviour of water/marine lubricating oil emulsions was tested at 100, 200 and 300° C. and compared to the behaviour at these temperatures of a standard marine cylinder lubricating oil (shown in Table 7).

Table 4 presents the results of the high-temperature tests performed on the water/marine lubricating oil emulsions and the standard oil. The TBN of emulsions before the test and after the test (material accumulated in the test cell sump) were determined. The TBN of emulsions after the test were higher than the TBN of emulsions before the test, which would suggest that the emulsions were concentrated (through water loss) and KOH, existent in emulsions, did not deposit on the test panel.

TABLE 4

| Sample | Test temperature (° C.) | Δm* (g) | TBN Before | TBN After |
|---|---|---|---|---|
| DI emulsion | 100 | 0.0006 | 63.0 | 64.6 |
| SW emulsion | 100 | 0 | 64.6 | 65.5 |
| Standard | 100 | 0 | 69.9 | 69.9 |
| DI emulsion | 200 | 0.0097 | 63.0 | 70.2 |
| SW emulsion | 200 | 0.0253 | 64.6 | 69.5 |
| Standard | 200 | 0.0002 | 69.9 | 69.9 |

TABLE 4-continued

| Sample | Test temperature (° C.) | Δm* (g) | TBN Before | TBN After |
|---|---|---|---|---|
| DI emulsion | 300 | 0.0460 | 63.0 | 73.2 |
| SW emulsion | 300 | 0.0468 | 64.6 | 69.8 |
| Standard | 300 | 0.0019 | 69.9 | 70.1 |

Abbreviations:
DI = deionized water;
SW = synthetic sea-water
*Δm = panel mass before hot test - panel mass after hot test

Neutralisation of Sulfuric Acid

The efficiency of water/lubricant oil emulsion in neutralising sulfuric acid was tested using two methods: a beaker neutralisation and a high temperature neutralisation. The latter used the same test-cell as shown in FIG. 4.

Beaker Neutralization 75.15 g of water/lubricant oil emulsion was weighed in a beaker. 2.25 g of sulfuric acid (96% w/w) was then added to the beaker. The mixture was sheared for 5 minutes using a high shear Turrax mixer set up at 24000 rpm. The TBN of the water/lubricant oil emulsion was measured before and after the test. This test was repeated using the standard marine cylinder lubricant described in Table 7. Table 5 presents the results of the beaker neutralization test. It can be seen that the efficiency of water/lubricant oil emulsion in neutralizing sulfuric acid is comparable to the efficiency of the standard oil in neutralizing sulfuric acid.

TABLE 5

| Beaker Neutralization Test Results | | | |
|---|---|---|---|
| | TBN | | Rate of |
| Sample | Before | After | Neutralization* |
| DI emulsion | 64.5 | 33.3 | 6.3 |
| Standard | 70.4 | 37.6 | 6.6 |

Abbreviations:
DI = deionized water
Rate of Neutralization = $dc_{KOH}/dt \cong dTBN/dt$

High Temperature Neutralization

The test set-up shown in FIG. 4 was used for assessing the efficiency of water/lubricant oil emulsions in neutralizing sulfuric acid at hot temperatures. The panel was heated to 100° C. As soon as this temperature was reached, the flow of water/lubricant oil emulsion was started through Inlet 1 at 1.67 ml/min. When the emulsion covered the panel, the flow of sulfuric acid was started through Inlet 2 at 0.05 ml/min. The water/lubricant oil emulsion was dosed through a 1 mm bore size tube connected to a peristaltic pump, whereas the acid was dosed through a fine needle (21 G×35 mm), with the help of a syringe pump. The experiment was repeated at 200° C. The standard oil was also assessed at 100 and 200° C. The results of these tests are described in Table 6:

TABLE 6

| Hot Temperature Neutralization Tests | | | |
|---|---|---|---|
| | Test temperature | TBN | |
| Sample | (° C.) | Before | After |
| DI emulsion | 100 | 64.9 | 63.8 |
| Standard oil | 100 | 71.1 | 69.3 |
| DI emulsion | 200 | 65.2 | 47.7 |
| Standard oil | 200 | 71.1 | 58.0 |

The aim of this test was to mimic a real situation when the lubricating oil meets the sulfuric acid, formed during the combustion, on the surface of the hot metal cylinder walls. The results from Table 6 illustrate that neutralization of sulfuric acid by the emulsion or by the standard oil was minimal at 100° C. At 200° C. the emulsion and the standard oil partially neutralized the sulfuric acid.

The tests performed on the water/lubricant oil emulsions showed that KOH existent in these emulsions would not deposit on the hot cylinder walls and would neutralize the sulfuric acid formed during the combustion. These conclusions are based on comparison work performed on a standard marine oil lubricant.

Bolnes Engine Test

Bolnes is a turbocharged, 3 cylinder, 2 stroke, low speed marine diesel engine. The Bolnes engine test allows the simultaneous testing of three different cylinder oils over a 72 hour period. In the standard test each cylinder lubricant is tested in turn in each cylinder of the engine. Several parameters are rated/measured in this test. The most important ones are cleanliness ratings, piston ring wear, cylinder liner wear and analyses of the cylinder drain samples. The piston ring grooves, lands and skirt and the scavenging port clogging are rated for cleanliness. The weight loss of the rings is recorded as a measure of piston ring wear. The cylinder drain samples are analyzed for TBN, TAN, ICP/AES, KV100.

Emulsion lubricant was tested in a Bolnes engine test, which only used one lubricant/cylinder (72 hour test). Cylinder 1 used an emulsion lubricant at 100% treat rate, cylinder 2 used a standard marine cylinder lubricant and cylinder 3 used an emulsion lubricant at 125% treat rate. The reason for testing an emulsion lubricant at 125% treat rate was to allow a fairer comparison between the standard lubricant and emulsion lubricant. Emulsion lubricant is composed of 80% w/w oil phase, hence at 100% treat rate it will deliver less oil than the standard marine cylinder lubricant. However, at 125% treat rate, emulsion lubricant delivers 100% oil, allowing for a fairer comparison between emulsion lubricant and the standard marine cylinder lubricant. The composition of the tested emulsions and the standard marine cylinder lubricant are presented in Table 7.

TABLE 7

| Lubricants Tested in the Bolnes Engine Test | | | |
|---|---|---|---|
| Ingredients | 'Standard' Emulsion lubricant (% w/w) | Conventional Marine Cylinder Lubricant | 'Over-treat' Emulsion lubricant (% w/w) |
| KOH | 7.00 | — | 5.6 |
| Deionized water | 13.00 | — | 14.4 |
| Petroleum solvent | 1.12 | — | 0.90 |
| HDSA:DMEA | 0.31 | — | 0.25 |
| PIBSA:EG:DMEA | 1.19 | — | 0.94 |
| PIBSA:TEPA | 1.67 | — | 1.34 |
| calcium dodecyl phenate sulphide | 2.74 | — | 2.19 |
| Conventional additive package | — | 20.75 | — |
| ESSO 600SN | 36.49 | 57.06 | 37.19 |
| ESSO 150 BRIGHTSTOCK | 36.49 | 22.19 | 37.19 |
| Cylinder Number | 1 | 2 | 3 |
| Treat Rate in the Bolnes Engine (%) | 100 | 100 | 125 |
| TBN delivered at above treat rate (mg KOH/g) | 70 | 70 | 70 |

*CAS #64742-48-9 viscosity 2 @ 25 C and boiling point @ 185 C

Analyses of the Drain Oil Samples

Eight drain oil samples (representing the excess oil from the combustion chambers) were collected during the running of the test: at time 0 and after 4, 8, 24, 36, 48, 60, 72 hours. These samples were submitted for TBN, TAN and ICP/AES analyses. The results of these analyses gave information on the neutralization of the sulfuric acid formed during the combustion and the corrosive wear.

FIGS. 1 and 2 show the changes in TBN and TAN in time in the oil samples collected from cylinders 1-3. The sulfur present in the residual heavy fuel, combusted in the Bolnes engine, is oxidized during combustion of the fuel to form various acidic products. As the base present in the emulsion lubricants or standard marine cylinder lubricant (mcl) reacted with the products of the sulfur oxidation, the TBN decreased until it reached equilibrium. This equilibrium was reached after ~36 hours in drain oils from the cylinders, which used emulsion lubricant and after ~60 hours in the drain oils from the cylinders, which used standard mcl. This might indicate a more efficient neutralization of the sulfur oxidation products achieved by emulsion lubricant than by the standard mcl. The TAN of the drain oil samples increased in time until it reached equilibrium. The equilibrium was achieved after ~36 hours in the cylinders, which used emulsion lubricant and after ~60 hours in the cylinder, which used the standard mcl.

All the drain oil samples collected during the running of the Bolnes engine were analyzed by ICP/AES. The products of the sulfur oxidation formed during the fuel combustion can 'attack' the metal of the liners or the piston and cause corrosive wear, thus iron, copper, nickel, chromium, lead products form and can be detected by the analyses of the drain oils. FIG. 3 shows the iron content present in the drain oil samples collected from cylinders 1-3. It can be observed that the iron content of the drain oil samples collected from cylinders 1 and 3 raised for 24 hours and after that time it reached a plateau. The analyses of the drain oil samples collected from the cylinder 2 showed that the iron content increased in time and did not reach a plateau during the whole length of the test.

Table 8 summarizes the wear metal content of the drain oil samples at time zero and at the end of the test. The drain oil sample from cylinder 2 contained more iron, copper, nickel and chromium than the drain oil samples from cylinders 1 and 3. These results suggest that emulsion lubricant caused less corrosive wear of the components of the cylinder than the standard mcl.

TABLE 8

ICP/AES Analyses of the Drain Oils - Wear Metal Content

| Metal Content | Cylinder 1 | | Cylinder 2 | | Cylinder 3 | |
|---|---|---|---|---|---|---|
| (ppm) | 0 hours | 72 hours | 0 hours | 72 hours | 0 hours | 72 hours |
| Fe | 1 | 1694 | 7 | 3145 | 1 | 1152 |
| Cu | 0 | 93 | 0 | 124 | 0 | 36 |
| Ni | 1 | 76 | 1 | 93 | 1 | 64 |
| Cr | 0 | 7 | 0 | 10 | 0 | 7 |
| Pb | 0 | 3 | 0 | 2 | 0 | 0 |
| Type of lubricant | 'Standard' Emulsion lubricant emulsion | | Standard mcl | | 'Over-treat' Emulsion lubricant emulsion | |

Engine Parts Ratings and Measurements

This section is meant to summarize the ratings and measurements of the Bolnes engine parts after the test.

Piston Ratings:

Table 9 presents the results of the piston ratings. Overall, the piston ratings show an equivalent or in some cases better performance from the emulsion lubricant than from the standard mcl.

TABLE 9

Bolnes Engine Test Results, Piston Ratings

| Rating | Piston 1 | Piston 2 | Piston 3 | Comments/Observations |
|---|---|---|---|---|
| Piston Groove Carbon (average merits) | 6.43 | 6.22 | 6.46 | Overall, the piston ratings show a similar performance from emulsion lubricants as from a standard marine cylinder lubricant. |
| Piston Land Carbon (average merits) | 5.25 | 5.49 | 5.56 | |
| /Piston Groove Carbon Fill (%) | 35.73 | 37.80 | 35.40 | |
| Piston Ring Stick (merits) | 9.88 | 10.00 | 10.00 | |
| Piston Ring Weight Loss (average grams) | 4.540 | 4.758 | 3.988 | Less piston ring weight loss noticed in the rings of pistons 1 and 3 than in the rings of piston 2 —'over-treat' emulsion lubricant better than 'standard' marinox better than the standard mcl |
| Ring Corrosion (descriptive) | Trace-light corrosion | Light corrosion | Trace corrosion | More corrosion of the top-face of the ring was noticed in piston 2 than in pistons 1 and 3. 'Over-treat' emulsion lubricant induced the least corrosion of the top face of the ring. |
| Scuffing (descriptive) | Trace-light | Trace | Trace | Slightly more scuffing was noticed on piston 1 than on pistons 2 and 3. |

Cylinder Ratings:

Table 10 presents the ratings of the liner and air inlet port blockage. Overall the emulsion lubricant performed better than the standard mcl. The emulsion lubricant did not cause quill deposits and air inlet ports deposits and formed fewer deposits on the liners than the standard mcl. Corrosion was noticed on the liner of the cylinder, which run on the standard mcl and this was not noticed on the liners of the cylinders, which run on emulsion lubricant.

TABLE 10

Cylinder Ratings

| Rating | Cylinder 1 | Cylinder 2 | Cylinder 3 | Comments/Observations |
|---|---|---|---|---|
| Liner Diameter Increase (average - mm) | 0.034 | 0.062 | 0.030 | Less average liner diameter increase noticed in the cylinders 1 and 3 than in the cylinder 2 - Emulsion lubricant formed less deposit than the standard mcl. |
| Liner Condition (visible honing lines/polished surface —%) | 5/95 | 10/90 | 5/95 | The surface of the liners 1 and 3 appeared to have less visible honing lines and a higher polished surface than the liners of cylinder 2 - Emulsion lubricant emulsions caused slightly more abrasive wear than the standard mcl. |
| Liner Condition (descriptive) | Areas of dark brown to black lacquer | Trace corrosion throughout with small areas of dark brown to black lacquer | Areas of dark brown to black lacquer | The liner of cylinder two shows trace corrosion, which was not observed on the liners of cylinders 1 and 3 - Emulsion lubricant caused less corrosive wear than the standard mcl. |
| Air Inlet Port Blockage (descriptive) | Nil | Trace | Nil | The standard mcl caused trace blockage of the air inlet port - this was not observed in cylinders 1 and 3, which used Emulsion lubricant emulsion. |
| Fire land deposits (descriptive) | Mainly removed | Mainly black | Trace flaking | Emulsion lubricant caused only traces of fire land deposits, while the standard mcl caused black deposits |
| Quill deposits (descriptive) | Nil | Trace-light | Nil | Emulsion lubricant did not cause quill deposits |

Summary of the Bolnes Test Ratings and Analyses

In summary the emulsion lubricant resulted in improved properties over the standard marine cylinder lubricant in tests for piston ring groove carbon, piston ring land carbon, piston ring weight loss, corrosive wear, liner diameter increase, fire land and quill deposits, and air inlet blockage. The emulsion lubricant resulted in comparable properties for the ring stick and adhesive wear. Depending on the need for acid neutralization, the treat rate with the emulsion lubricant of this disclosure may be less than the treat rate with standard marine cylinder lubricants. Further the emulsion lubricants are compatible with standard marine cylinder lubricants and could be blended to obtain optimal properties and to reduce costs.

Examples Using Solid Bases

Solid bases such as $Ca(OH)_2$, $CaCO_3$, MgO/NaOH and $Mg(OH)_2$ were suspended in a water phase. The dispersion was then dispersed in a lubricating oil. The stability of emulsions (dispersions) made with these bases to phase separation was studied. The performance of the $Ca(OH)_2$ and MgO/NaOH emulsions in a Bolnes engine test is also detailed.

The water in oil emulsions described in the following examples contain 20% w/w base suspension in water and 80% w/w oil formulation. The oil formulation contains 1-2% w/w emulsifying surfactants, ~2% w/w dispersant, ~3% w/w antioxidant detergent and 93-94% w/w SAE-50 oil. The emulsifiers used comprise the low HLB PIBSA:EG:DMEA and the high HLB HDSA:DMEA emulsifiers previous shown and described for soluble bases along with the potential alternate or supplementary high HLB salixarene emulsifier shown below.

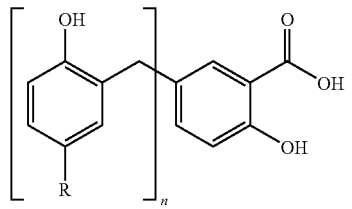

(R = PIB MW~550)

Where R is approximately a 550 number average molecular weight polyisobutylene oligomer and n is a value between 1 and 10, more desirably between 1 and 4. These salixarene or their metal salts, salixarates, are more generally referred to as detergents and are described as a detergent in this application, but they may also function as an emulsifier or surfactant. These types of compounds are generally taught in U.S. Pat.

No. 6,200,936, which is hereby incorporated by reference for its teachings on making both linear and cyclic salixarenes and their metal salts, salixarates.

The $Ca(OH)_2$, was purchased as a fine suspension in water. The $CaCO_3$ was prepared in-situ, by the addition of fine particulate $CaCO_3$ (base), to water. In one example MgO was also suspended in NaOH solution, to reduce the cost of the formulation. The bases were dispersed in such quantity, so to deliver 60-70 TBN in the final emulsion. Higher or lower TBNs can also be obtained by varying the amount of base dissolved in water accordingly.

An emulsifying concentrate can be prepared as previously described for the dissolved base products by mixing the two surfactants until homogeneous. This concentrate is then mixed with the oil, which contains a dispersant and an anti-oxidant. The concentrate+oil mixture are weighed in a beaker to which the base suspension is added. The mixture is then sheared for 3-6 minutes using a high shear device, such as a Silverson or a Turrax mixer.

The emulsifying surfactants can be mixed with the oil, dispersant and anti-oxidant to form an oil formulation. This oil formulation is weighed into a beaker to which the base suspension is added. The mixture is then sheared for 3-6 minutes using a high shear device, such as a Silverson or a Turrax mixer.

Emulsion Stability

Water/marine lubricating oil emulsions are stored at room temperature and 60° C. in order to assess their stability in time. Stability is assessed after 7 days at room temperature, 7 days at 60° C. and 28 days at room temperature. Emulsion stability is semi-quantitatively evaluated by % v/v separation of oil, oily emulsion, band and water. The presence of water is considered particularly detrimental. Examples for emulsion stability are presented in Table 11.

TABLE 11

Emulsion Storage Stability for Solid Bases

| Type of emulsified base | Emulsifier surfactant (% w/w in emulsion) | 7 days at room temperature (% v/v) | | | | 7 days at 60° C. (% v/v) | | | | 28 days at room temperature (% v/v) | | | |
|---|---|---|---|---|---|---|---|---|---|---|---|---|---|
| | | Oil | Oily | Band | Water | Oil | Oily | Band | Water | Oil | Oily | Band | Water |
| $Ca(OH)_2$ | 1.40 | 2 | — | — | — | 3 | — | 1 | — | 3 | — | 1 | — |
| $CaCO_3$ | 1.50 | — | 1 | 1 | — | 3 | — | 2 | — | — | 2 | 2 | — |
| MgO/NaOH = 1/1 (A) | 1.50 | — | 1 | 1 | — | 2 | 1 | 2 | — | 1 | 2 | 1 | — |
| MgO/NaOH = 2/1 | 1.50 | — | — | — | — | 2 | 1 | 2 | — | — | 2 | 1 | — |

Two of the emulsions, a $Ca(OH)_2$ and a MgO/NaOH emulsion, were tested as marine cylinder lubricants in the Bolnes engine test.
The $Ca(OH)_2$ emulsion used a ready made suspension of 18 wt. % $Ca(OH)_2$ in water.
The MgO/NaOH emulsion used a suspension of MgO in NaOH aqueous solution.
This suspension was prepared internally, just before the preparation of the emulsion.
Table 12 details the composition of the emulsions made for this test.

TABLE 12

Emulsion Lubricants tested in the Bolnes Engine Test

| Ingredients | $Ca(OH)_2$ Emulsion (% w/w) | MgO/NaOH Emulsion (% w/w) |
|---|---|---|
| ($Ca(OH)_2$ suspension in water) | 20.00 | — |
| MgO | — | 1.55 |

TABLE 12-continued

Emulsion Lubricants tested in the Bolnes Engine Test

| Ingredients | $Ca(OH)_2$ Emulsion (% w/w) | MgO/NaOH Emulsion (% w/w) |
|---|---|---|
| NaOH in water | — | 0.77 |
| Deionised Water | — | 17.68 |
| Linear salixarene emulsifier n = 1-4 and R = polyisobutylene MW 550 | 0.42 | 0.42 |
| PIBSA:EG:DMEA emusifier | 0.98 | 0.98 |
| Nominally 1000 MW polyisobutylene grafted onto succinic anhydride (PIBSA) and further reacted with a mixed tetraethylenepentamine (TEPA)to form an imide PIBSA:TEPA = 3:1 (eq) A dispersant | 1.38 | 1.38 |
| Calcium dodecyl phenate sulphide | 2.26 | 2.26 |
| ESSO 600N | 43.07 | 43.07 |
| ESSO 150BS | 31.90 | 31.90 |
| Treat Rate in the Bolnes Engine (%) | 121.6 | 121.6 |
| TBN delivered at above treat rate (mgKOH/g) | 70 | 70 |

$Ca(OH)_2$ Emulsion

The oil phase (same for both $Ca(OH)_2$ and MgO/NaOH emulsions) was prepared prior to emulsification by mixing salixarene emulsifier, PIBSA:EG:DMEA emulsifier, dispersant, and calcium dodecyl phenate sulphide with the base oils ESSO 600N and 150BS. The $Ca(OH)_2$ in water was homogenized before use by gently inverting the storage bottle several times. 60 kg of emulsions were prepared in the following way: 80% w/w oil phase was weighed into a large container, followed by 20% w/w. A Silverson mixer (rotor stator type) was used to shear the oil phase with the water phase for 20 minutes, until an emulsion was formed. The particle size of this emulsion was assessed by a transmitted light microscope (magnification 400×). This was a way to check that enough shearing was put into the system, to emulsify $Ca(OH)_2$ suspension in water into the oil phase. The aim was to obtain an emulsion with small particles, since processes such as sedimentation are much slower when the emulsion particles are small and the emulsion had to be stable for the whole duration of the test. Although the majority of emulsion particles were smaller than 1 μm, particles of 20, 30 μm were also detected, so it was decided to shear this emulsion for further 20 minutes. After these additional 20 minutes of shearing the emulsion was re-examined. The emulsion particles were much reduced by the second shearing: the majority was submicron, although particles in the range 3-5 μm were also noticed. It was decided that no more shearing was necessary and the emulsion was used directly into the Bolnes engine.

MgO/NaOH Emulsion

The MgO/NaOH emulsion used the same oil phase as the $Ca(OH)_2$ emulsion. For the water phase NaOH was mixed with deionized water to form a solution. The NaOH solution was then mixed with the MgO powder. 60 kg of emulsions were prepared in the same way as the $Ca(OH)_2$ emulsion, but the $Ca(OH)_2$ suspension in water was replaced by the MgO/NaOH water phase. A Silverson mixer was used to shear the oil phase with the water phase for 20 minutes, until an emulsion was formed. The particle size of this emulsion was assessed under the microscope. Emulsion particles>10 μm were detected, so it was decided to shear this emulsion for further 20 minutes. After these additional 20 minutes of shearing the emulsion was re-examined and found to be mostly submicron, with particles ~2 μm also present. It was decided that no more shearing was necessary and the emulsion was used directly into the Bolnes engine.

After the first run of the engine, vertical scratches were noticed on the liners of the cylinders, which had used MgO/NaOH emulsion. These scratches ran from the quills to the fire land. At that time the scratches were interpreted as being the result of abrasive wear caused by MgO particles. It was decided to change the grade of MgO used in the emulsion for a finer grade[1], to check if the MgO particle size is the cause of the problem. A further 30 kg batch of MgO/NaOH emulsion was prepared and used in the third run of the engine. This batch was prepared similarly to the first MgO/NaOH emulsion: 20 minutes of shearing with the Silverson mixer, 20 minutes of rest and a further 20 minutes of shearing. This process resulted in an emulsion with 100% submicron particles.

The first two runs used MgO had a trimodal particle size distribution, with some particles as high as 100 μm. The third run used a finer grade of MgO having a monomodal particle size distribution, with biggest particles in the range of 15 μm.

Both emulsions made for the Bolnes test were put on storage at room temperature and 60° C., in order to gain more information on the stability of these emulsions. Table 13 presents the stability of emulsions in terms of oil+oily separation and banding.

TABLE 13

Storage Stability of $Ca(OH)_2$ and MgO/NaOH Emulsions

| | Stability at room temperature after 28 days (% v/v) | | | | Stability at 60° C. after 28 days (% v/v) | | | |
|---|---|---|---|---|---|---|---|---|
| Emulsion | Oil | Oily | Band | Water | Oil | Oily | Band | Water |
| $Ca(OH)_2$ | 2 | — | 1 | — | 4 | 2 | 3 | — |
| First MgO/NaOH | 2 | — | 1 | — | 7 | — | 5 | — |
| Second MgO/NaOH | — | 2 | 1 | — | 5 | — | 3 | — |

Standard Cylinder Lubricant

Table 14 presents the composition of the cylinder lubricant used as the standard in the Bolnes engine test. This standard was chosen for its very high performance as a marine cylinder lubricant. Hence, the emulsions were compared with a high performance lubricant.

TABLE 14

Standard Marine Cylinder Lubricant Tested in the Bolnes Engine Test

| Ingredients | Standard Marine Cylinder Lubricant (% w/w) |
|---|---|
| LZ9296 Commercial additive package for marine diesel from Lubrizol Corp. | 20.75 |
| ESSO 600N | 57.06 |
| ESSO 150BS | 22.19 |
| Treat Rate in the Bolnes Engine (%) | 100 |
| TBN delivered at above treat rate (mgKOH/g) | 70 |

5.2. Test Description and Plan

The Bolnes is a turbocharged, 2 stroke, 3 cylinder, low speed marine diesel engine as previously described. After each 72 hour run the lubricants are alternated between cylinders, so they are tested in turn in each cylinder of the engine. After each 72 hour run, the pistons are taken out of the cylinders, cleaned and rated.

Table 15 outlines the order of testing of each lubricant in the Bolnes engine together with the treat rates.

TABLE 15

Order of Testing of Lubricants and Treat Rates

| Run number | $Ca(OH)_2$ emulsion | MgO/NaOH emulsion | Standard marine lubricating oil |
|---|---|---|---|
| 1 | CYLINDER 1 121.6% Treat rate | CYLINDER 2 121.6% Treat rate | CYLINDER 3 100% Treat rate |
| 2 | CYLINDER 2 121.6% Treat rate | CYLINDER 3 121.6% Treat rate | CYLINDER 1 100% Treat rate |
| 3 | CYLINDER 3 121.6% Treat rate | CYLINDER 1 121.6% Treat rate | CYLINDER 2 100% Treat rate |

Both emulsions were used at 121.6% treat rate in the engine. Both emulsions are composed of 80% w/w oil phase, therefore, at 100% treat rate, they would deliver less oil than a standard marine cylinder lubricant. However, at 121.6% treat rate, they deliver ~97% oil, allowing for a fairer comparison between lubricant emulsions and the standard marine cylinder lubricant.

Drain oil samples were taken at 12 hour intervals during the running of the engine and analyzed for TBN, TAN and ICP/AES. The average results from all three runs are discussed in the following section.

This section analyses the average results of the three Bolnes engine runs. The average performance of the lubricant emulsions was compared with the average performance of the standard lubricant in terms of efficiency of neutralising the acids formed during the combustion (TAN and TBN analyses of the drain oils), protection against corrosion (wear metal analyses of the drain oils) and engine ratings.

FIGS. 5, 6 and 7 present the average change in TBN and TAN in the drain oils from $Ca(OH)_2$ emulsion, MgO/NaOH emulsion and the standard lubricant. The TBN in the drain oils from the $Ca(OH)_2$ emulsion reached an equilibrium slightly later than in the drain oils from the standard and MgO/NaOH emulsion, indicating a better 'delay' of the TBN depletion by the $Ca(OH)_2$ emulsion. On average, it seems that the TAN in the drain oils did not reach equilibrium during the 72 hour runs. However, the drain oils from the $Ca(OH)_2$ emulsion have the lowest TAN for most of the time and the lowest final TAN. This would indicate that the $Ca(OH)_2$ emulsion has a better neutralization ability than the other two lubricants. The final TAN value was similar for the MgO/NaOH emulsion as for the standard lubricant.

The excess of TAN over TBN started after ~30 hours in the cylinders which used $Ca(OH)_2$ emulsion and the standard lubricant and after ~14 hours in the cylinder which used MgO/NaOH emulsion. This might suggest that the neutralization ability of the MgO/NaOH emulsion was poorer than the $Ca(OH)_2$ emulsion and standard lubricant. One other explanation could be that the neutralization mechanism is different for calcium bases than for magnesium bases.

The change in the drain oils iron content in time is presented in FIG. 8.

The iron content of the drain oils was the lowest in the drain oils from the standard lubricant for the first ~36 hours. After this time, the iron content was the lowest in the drain oils of the $Ca(OH)_2$ emulsion and it also reached equilibrium in these drains. It also seemed to reach equilibrium in the drain oils of the MgO/NaOH emulsion. After 72 hours the iron content was the lowest in the $Ca(OH)_2$ emulsion, followed by the MgO/NaOH emulsion, with the standard having the highest iron content.

The average of other wear metal content in the drain oils is summarized in Table 16. The drain oils from the cylinders, which ran on $Ca(OH)_2$ emulsion had the least levels of wear metal content, emphasizing the superior performance of the $Ca(OH)_2$ emulsion. MgO/NaOH emulsion was similar to the standard in the wear metal content of the drain oils.

TABLE 16

ICP/AES Analyses of the Drain Oils/Average Results - Wear Metal Content

| Metal Content | $Ca(OH)_2$ emulsion | | MgO/NaOH emulsion | | Standard lubricant | |
|---|---|---|---|---|---|---|
| (ppm) | 0 hours | 72 hours | 0 hours | 72 hours | 0 hours | 72 hours |
| Fe | 6 | 5855 | 4 | 8330 | 6 | 8631 |
| Cu | 0 | 59 | 0 | 89 | 0 | 96 |
| Ni | 1 | 96 | 0 | 99 | 0 | 137 |
| Cr | 0 | 18 | 0 | 24 | 0 | 24 |
| Pb | 2 | 1 | 1 | 2 | 0 | 2 |

High Fe levels in the drain oils, high wear rates of the engine and high amount of quill and port deposits were detected in this Bolnes test. All oils, including the standard were equally affected, hence it does not seem to be lubricant related. The cylinder temperatures during this test were similar with temperatures measured in previous Bolnes tests. A possible cause for the unusually high wear rates and deposits could be the diesel fuel.

Piston and Cylinder Ratings:

The piston and cylinder ratings that could be averaged are detailed in Table 18.

TABLE 18

Piston and Cylinder Ratings/Average Results

| Rating | $Ca(OH)_2$ emulsion | MgO/NaOH emulsion | Standard Lubricant |
|---|---|---|---|
| Piston Groove Carbon (merit ratings) | 6.95 | 5.55 | 5.54 |
| Piston Land Carbon (merit ratings) | 4.87 | 4.11 | 4.32 |
| Piston Ring Weight Loss (grams) | 12.45 | 15.96 | 11.30 |
| Ring Corrosion (descriptive) | Light | Light-medium | Light-medium |
| Polish of the liner (%) | 4.3 | 5.0 | 5.7 |
| Quill deposits | 1 | 11 | 42 |
| Port Blockage | 0.7 | 2.0 | 6.7 |

The $Ca(OH)_2$ emulsion had higher groove and land ratings (better performance) than the other two lubricants (i.e. less groove and land deposits). The piston ring weight loss was slightly higher (slightly worse) than the standard but lower than the MgO/NaOH emulsion. The bore polish was slightly lower than the standard. $Ca(OH)_2$ emulsion had an outstanding performance (significantly better) in preventing the deposits of the quill and port.

With the MgO/NaOH emulsion the piston groove and land ratings deposits were similar to the standard. The piston ring weight loss was higher than the standard and the $Ca(OH)_2$ emulsion. The polish of the liner was similar to the standard. The quill and port deposits were much lower than the standard.

The Bolnes engine test results were very encouraging and were a proof of the high performance of the $Ca(OH)_2$ emulsion. The MgO/NaOH emulsion also had a good performance, in most respects similar to the standard lubricant.

Based on reductions in NOx seen with fuels that incorporate water, it is anticipated that the water in the marine emulsion lubricant will lower the combustion temperature in the cylinders slightly and thereby reduce the NOx emissions of the engine. The amount of NOx reduction will be determined by the total amount of water injected with the emulsion lubricant.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. While ranges are given for most of the elements of the invention independent of the ranges for other elements, it is anticipated that in more preferred embodiments of the invention, the elements of the invention are to be combined with the various (assorted) desired or preferred ranges for each element of the invention in various combinations. As used herein, the expression "consisting essentially of" permits the inclusion of substances that do not materially affect the basic and novel characteristics of the composition under consideration.

What is claimed:

1. A lubricant comprising a) a major amount of oil of lubricating viscosity, b) at least one emulsifier, derived from a hydrocarbyl substituted carboxylic acylating agent, the hydrocarbyl portion of said acylating agent having about 50 to 500 carbon atoms, capable of forming a water in oil emulsion, c) from about 2 to about 50 weight percent of an oil insoluble solvent or solvent blend and d) a base comprising magnesium oxide, magnesium hydroxide, magnesium carbonate, calcium hydroxide, or calcium carbonate or combinations thereof, wherein said base contributes at least 1 TBN to said lubricant, at least 10 wt. % of said base is insoluble in the oil insoluble solvent, and said insoluble base is added as a preformed chemical compound rather than being characterized as formed by an in situ chemical reaction within the oil phase of a aluminum, alkali or alkaline earth base with an acid in the presence of an emulsifier (overbasing) and wherein said base is not a borate compound.

2. A lubricant according to claim 1, wherein said base is in a dispersed phase having a number average particle size by light scattering of 5 nanometers to 100 microns.

3. A lubricant according to claim 1 having a TBN of at least 30 reported in units of mg KOH/g (more desirably 50) and said base is in a dispersed phase having a number average particle size by light scattering of from 5 nanometers to 100 microns.

4. A lubricant according to claim 1, wherein at least 50% of said TBN value is attributed to said insoluble base dispersed in said solvent.

5. A lubricant according to claim 1, further comprising at least one lubricating oil detergent comprising sulfurized alkylphenates.

6. A lubricant according to claim 1, wherein said lubricant is a lubricant designed to be injected into the ring or combustion area of an internal combustion engine.

7. A lubricant according to claim 6, wherein said lubricant is designed with a TBN of at least 40 to neutralize acidic reaction productions associated with high sulfur content fuels.

8. A lubricant in an internal combustion engine comprising;

a) from about 50 to about 99 wt. % of one or more oils of lubricating viscosity, b) from about 2 to 50 wt. % of an oil insoluble solvent c) from about 0.5 to about 15 wt. % of a emulsifier(s) capable of forming a water in oil emulsion comprising at least one emulsifier, derived from a hydrocarbyl substituted carboxylic acylating agent, the hydrocarbyl portion of said acylating agent having about 50 to 500 carbon atoms, and d) from about 0.5 to about 30 wt. % of a base comprising magnesium oxide, magnesium hydroxide, magnesium carbonate, calcium hydroxide, or calcium carbonate or combinations thereof, wherein said base contributes at least 1 TBN to said lubricant, at least 10 wt. % of said base is insoluble in said oil insoluble solvent, and said base is added as a preformed chemical compound rather than being characterized as being formed by an in situ chemical reaction within the oil phase of a aluminum, alkali, or alkaline earth base with an acid in the presence of an emulsifier (overbasing), and wherein said base is not a borate compound, and optionally wherein the insoluble portion of said base is dispersed in said oil insoluble solvent forming a blended solvent base that is then dispersed in said oils of lubricating viscosity.

9. A method of lubricating at least some of the surfaces of the combustion chamber of an internal combustion engine including the steps of adding a lubricating oil with a TBN of at least 10 from dispersible particulate base additives into the combustion chamber, adding fuel to the combustion chamber, and combusting the fuel in said combustion chamber, the improvement comprising incorporating at least 10 mole percent of the base of the TBN as a dispersible particulate base comprising magnesium oxide, magnesium hydroxide, magnesium carbonate, calcium hydroxide, or calcium carbonate or combinations thereof dispersed in an oil insoluble solvent, wherein at least 10 wt. % of said base is insoluble in said oil insoluble solvent, and then dispersed into said lubricating oil as an emulsified phase using an emulsifier derived from a hydrocarbyl substituted acylating agent, the hydrocarbyl portion thereof having about 50 to 500 carbon atoms, such that the TBN of said lubrication oil is at least 10 units on the TBN scale expressed as mg KOH/g of oil higher than before incorporating said dispersible particulate base and wherein said base is added as a preformed chemical compound rather than being formed by in situ chemical reaction within the oil phase of aluminum, alkali or alkaline earth base with an acid in the presence of an emulsifier (overbasing).

10. The method of claim 9, wherein said base, when added is in a dispersed phase having a number average particle size by light scattering of from 5 nanometers to 100 microns; and wherein said lubricating oil further comprises a lubricating oil detergent.

11. The method of claim 9, wherein the TBN of said lubricating oil is increased by at least 30 units by incorporating said dispersible particulate base in said oil-insoluble solvent.

12. The method of claim 9, wherein said dispersible particulate base in oil-insoluble solvent comprises MgO, $Mg(OH)_2$, $Ca(OH)_2$, or $CaCO_3$, or blends thereof.

13. The method of claim 9, wherein said lubricating oil added to said combustion chamber includes from about 5 to about 30 wt. % water and from about 5 to about 30 wt. % of said base(s).

14. The method of claim 9, wherein said internal combustion engine is a marine diesel engine and said fuel has a sulfur content from about 0.1 to about 4.5 weight percent which generates acidic reaction products in said combustion chamber.

15. A process for forming a lubricant with a total base number of at least 1 comprising; a) dispersing a portion of base in an oil-insoluble solvent e.g. water, b) adding said base and oil insoluble solvent to a lubricating oil, c) emulsifying said oil insoluble solvent and base in said lubricating oil using an emulsifier derived from a hydrocarbyl substituted carboxylic acylating agent, the hydrocarbyl portion of said acylating agent having about 50 to 500 carbon atoms, capable of forming a water in oil emulsion, wherein at least 10 wt. % of said base is insoluble in the oil insoluble solvent and said base comprising magnesium oxide, magnesium hydroxide, magnesium carbonate, calcium hydroxide, or calcium carbonate or combinations thereof and wherein said base contributes at least 1 mg KOH/g to the TBN of said lubricant and wherein said base is added as a preformed chemical compound rather than being formed in situ in the oil phase by reacting aluminum, alkali, or alkaline earth base with an acid in the presence of an emulsifier (overbasing) and wherein said base is not a borate.

16. A method of lubricating an internal combustion engine including the steps of adding a lubricating oil with a TBN of at least 1 mg KOH/g into the lubricant recirculating system of the engine, adding fuel to the combustion chamber, and combusting the fuel in said combustion chamber, the improvement comprising incorporating a water dispersible base comprising magnesium oxide, magnesium hydroxide, magnesium carbonate, calcium hydroxide, or calcium carbonate or combinations thereof dispersed in an oil insoluble solvent comprising a C1-C5 mono or polyhydric alcohol, C2-C5 ether, and/or water, into said lubricating oil as an emulsified phase using an emulsifier derived from a hydrocarbyl substituted carboxylic acylating agent, the hydrocarbyl portion of said acylating agent having about 50 to 500 carbon atoms, capable of forming a water in oil emulsion, such that the TBN of said lubricating oil is at least 1 units, on the TBN scale expressed as mg KOH/g of oil higher than before incorporating said water dispersible base and wherein at least 10 wt. % of said base is insoluble in the oil insoluble solvent and said base is added as a preformed chemical compound rather than being formed by in situ chemical reaction in the oil phase between aluminum, alkali, or alkaline earth base and an acid in the presence of an emulsifier (overbasing) and wherein said base is not a borate.

17. A lubricant comprising a) a major amount of oil of lubricating viscosity b) at least on emulsifier capable of forming a water in oil emulsion comprising at least one emulsifier, derived from a hydrocarbyl substituted carboxylic acylating agent, the hydrocarbyl portion of said acylating agent having about 50 to 500 carbon atoms, c) sufficient base comprising magnesium oxide, magnesium hydroxide, magnesium carbonate, calcium hydroxide, or calcium carbonate or combinations thereof to impart a total base number (TBN) of at least 40 mg KOH/g of lubricant optionally dispersed or dissolved in an oil insoluble solvent or solvent blend, wherein at least 10 wt. % of said base is insoluble in the oil insoluble solvent or solvent blend, d) from about 0.1 to about 4 wt. % of one or more ashless dispersants (PIB containing or PIB-free), e) from about 0.1 to about 20 wt. % of one or more detergents, and f) optionally one or more antiwear additives or one or more antioxidants, wherein at least 20 percent of the total base number is contributed by a base added as a preformed chemical compound that is other than a base characterized as being a base formed by an in situ chemical reaction within the oil phase of a aluminum, alkali or alkaline earth base with an acid in the presence of an emulsifier (overbasing) and wherein said at least 20 percent of the total base number is provide by a base that is not a borate compound.

18. A method of using the lubricant of claim 17 to lubricate the pistons of a marine diesel engine.

19. A method according to claim 18, wherein said base is at least 10 wt. % in particulate form and wherein said one or more detergents comprises sulfurized alkylphenates.

20. A lubricant according to claim 17, wherein at least 60% of said total base number is provided by a base other than an overbased detergent.

21. A lubricant according to claim 17, wherein at least 70% of said total base number is provided by a base other than an overbased detergent.

22. A lubricant for a 2-stroke marine diesel engine having a total base number (TBN) above 40 mg KOH/g comprising a) a major amount of oil of lubricating viscosity and an oil insoluble solvent or solvent blend, b) a source of base comprising magnesium oxide, magnesium hydroxide, magnesium carbonate, calcium hydroxide, or calcium carbonate or combinations thereof contributing at least 10 mgKOH/g of oil to said TBN, said source of base being other than conventional overbased detergents and said source of base being uniformly present in a dispersible form in said oil, wherein at least 10 wt. % of said base is insoluble in the oil insoluble solvent, c) at least one emulsifier, derived from a hydrocarbyl substituted carboxylic acylating agent, the hydrocarbyl portion of said acylating agent having about 50 to 500 carbon atoms, capable of forming a water in oil emulsion, and d) an additive package comprising a lubricating oil detergent contributing no more than 30 mg KOH/g to the finished lubricant.

23. A lubricant according to claim 22 wherein d comprises 1) a total of 0.1-10% by weight of one or more conventional detergents each having a TBN of no more than 200 mg KOH/g, 2) a total of 0.1-5% by weight of one or more dispersants or emulsifiers, 3) optionally a total of 0.01-5% by weight of one or more anti-wear additives, and 4) optionally a total of 0.1-5% by weight of one or more anti-oxidants, wherein said % by weight is based upon the weight of said lubricant.

24. A lubricant according to claim 22 wherein the TBN of said lubricant is in the range 40-100 mg KOH/g.

25. A lubricant according to claim 23 wherein no more than 50% of the total TBN of said lubricant comes from conventional overbased detergents.

26. A lubricant according to claim 23 wherein conventional overbased detergents contribute no more than 20 mg KOH/g to the lubricant.

27. A lubricant according to claim 23 without any anti-wear additive.

28. A lubricant according to claim 23 without any supplementary anti-oxidant.

* * * * *